US012753949B2

(12) United States Patent
Mou et al.

(10) Patent No.: US 12,753,949 B2
(45) Date of Patent: Oct. 6, 2026

(54) INDOOR AIR POLLUTION PREVENTION SYSTEM

(71) Applicant: Microjet Technology Co., Ltd., Hsinchu (TW)

(72) Inventors: Hao-Jan Mou, Hsinchu (TW); Chin-Chuan Wu, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 298 days.

(21) Appl. No.: 18/616,661

(22) Filed: Mar. 26, 2024

(65) Prior Publication Data

US 2025/0035334 A1 Jan. 30, 2025

(30) Foreign Application Priority Data

Jul. 27, 2023 (TW) ..... 112128190

(51) Int. Cl.
*B01D 53/02* (2006.01)
*F24F 8/108* (2021.01)
(Continued)

(52) U.S. Cl.
CPC ..... *F24F 13/28* (2013.01); *F24F 8/108* (2021.01); *F24F 11/34* (2018.01); *F24F 2110/64* (2018.01); *F24F 2110/65* (2018.01)

(58) Field of Classification Search
CPC ..... F24F 11/0001; F24F 11/34; F24F 13/28; F24F 2110/10; F24F 2110/20;
(Continued)

(56) References Cited

U.S. PATENT DOCUMENTS 10,222,360 B1 * 3/2019 Nourbakhsh ..... G01N 33/0075
11,976,847 B2 * 5/2024 Ruia ..... B01D 46/444
(Continued)

FOREIGN PATENT DOCUMENTS

CN 107073469 A 8/2017
CN 207881086 U 9/2018
(Continued)

OTHER PUBLICATIONS

Extended European Search Report for European Application No. 24182043.0, dated Dec. 12, 2024.

*Primary Examiner* — Christopher P Jones
(74) *Attorney, Agent, or Firm* — Birch, Stewart, Kolasch & Birch, LLP

(57) ABSTRACT

An indoor air pollution prevention system is disclosed and includes an indoor field unit, an outdoor field unit, a gas exchange device, plural gas detectors and a cloud computing service device. Arranging the plural gas detectors in indoor and outdoor field units to detect air pollutions, and output air pollution data. An intake filter device is disposed in an intake channel of the gas exchange device and an exhaust filter device is disposed in an exhaust channel of the gas exchange device. The cloud computing service device receives and stores the air pollution data detected in the indoor and the outdoor field units, determines the location of the air pollution, and issues a control command to the intake filter device and the exhaust filter device to enable them to exchange the air. A directional airflow in the indoor field unit is generated to guide the air pollution to be filtered.

20 Claims, 27 Drawing Sheets

(51) Int. Cl.

| | |
|---|---|
| ***F24F 11/34*** | (2018.01) |
| ***F24F 13/28*** | (2006.01) |
| *F24F 110/64* | (2018.01) |
| *F24F 110/65* | (2018.01) |

(58) Field of Classification Search
CPC ..... F24F 2110/50; F24F 2110/52; F24F 2110/64; F24F 2110/65; F24F 2110/66; F24F 2110/70; F24F 2110/72; F24F 2110/74; F24F 7/003; F24F 7/08; F24F 8/108; F24F 8/20; F24F 8/22; F24F 8/30; G01N 33/004; G01N 33/0047; G01N 33/0063; G01N 33/0068; G01N 33/0075; G06N 20/00; Y02B 30/70
See application file for complete search history.

(56) References Cited

U.S. PATENT DOCUMENTS

| | | | | |
|---|---|---|---|---|
| 2009/0265037 | A1* | 10/2009 | Bassa | B60H 1/00771 700/306 |
| 2014/0260692 | A1* | 9/2014 | Sharp | F24F 11/74 73/863.23 |
| 2018/0250430 | A1* | 9/2018 | Machovina | B01D 53/30 |
| 2019/0078802 | A1* | 3/2019 | Xue | F24F 11/30 |
| 2019/0108746 | A1* | 4/2019 | Chang | B60H 1/008 |
| 2019/0391052 | A1* | 12/2019 | Lavrovsky | F24F 11/30 |
| 2020/0224915 | A1* | 7/2020 | Nourbakhsh | F24F 11/54 |
| 2021/0063036 | A1* | 3/2021 | Oh | G06V 10/764 |
| 2021/0372646 | A1 | 12/2021 | Brasher et al. | |
| 2023/0233976 | A1* | 7/2023 | Mou | B01D 46/46 422/111 |
| 2023/0408477 | A1* | 12/2023 | Raju | B60H 1/008 |

FOREIGN PATENT DOCUMENTS

| | | | |
|---|---|---|---|
| CN | 107073469 | B | 5/2020 |
| CN | 217383194 | U | 9/2022 |
| CN | 116481106 | A | 7/2023 |
| JP | 6-185770 | A | 7/1994 |
| JP | 2016-173193 | A | 9/2016 |
| JP | 2021-139611 | A | 9/2021 |
| JP | 2022-98449 | A | 7/2022 |
| JP | 2022-98459 | A | 7/2022 |
| JP | 2022-171551 | A | 11/2022 |
| JP | 2022-176062 | A | 11/2022 |
| TW | 200817329 | A | 6/2006 |
| TW | I620902 | B | 4/2018 |
| TW | I796113 | B | 3/2023 |
| TW | 202331163 | A | 8/2023 |

* cited by examiner

3

3

INDOOR AIR POLLUTION PREVENTION SYSTEM

CROSS-REFERENCE TO RELATED APPLICATION

This application claims priority to Taiwan Patent Application No. 112128190, filed on Jul. 27, 2023. The entire contents of the above-mentioned patent application are incorporated herein by reference for all purposes.

FIELD OF THE INVENTION

The present disclosure relates to an indoor air pollution prevention system, and more particularly to an indoor air pollution prevention system suitable for various indoor fields.

BACKGROUND OF THE INVENTION

Suspension particles are solid particles or droplets within the gas. Since the suspension particles are extremely fine, it is often that the suspension particles are inhaled into the lung by passing through the nose hair inside the nasal cavity of human's body. As a result, inflammation of the lungs, asthma or cardiovascular diseases are caused. Furthermore, if the suspension particles are attached with other pollutants, it will be more harmful to the respiratory system of human's body. Recently, the problem of the gas pollution is getting worse, especially, the concentration data of fine suspended particles, e.g., PM2.5, is often too high. Therefore, the detection of the concentration of the suspension particles is getting more attention. However, since the gas flows unstably owing to the wind direction and air volume, and the conventional air quality monitoring stations used for detecting the suspension particles are fixedly disposed at certain locations, people cannot check the concentration of the suspension particles in the surrounding environment.

Moreover, people pay more attention to the quality of the air around their lives. For example, carbon monoxide, carbon dioxide, volatile organic compounds (VOC), PM2.5, nitric oxide, sulfur monoxide and even the suspended particles contained in the air are exposed in the environment to affect the human health, and even endanger the life seriously. Therefore, the quality of environmental air has attracted the attention of various countries. How to detect the air quality and avoid the harm from the area with poor air quality is a problem that urgently needs to be solved.

In order to confirm the quality of the air, it is feasible to use a gas detector to detect the air surrounding in the environment. If the detection information is provided in real time to warn the people in the environment, it is helpful of avoiding the harm and facilitates the people to escape the hazard immediately. Thus, it prevents the hazardous gas exposed in the environment from affecting the human health and causing the harm. Therefore, it is a very good application to use a gas detector to detect the air in the surrounding environment.

However, it is not easy to control the indoor air quality. In addition to the air quality of the outdoor space, the air environmental conditions and pollution sources are the major factors that affect indoor air quality. There is needs of intelligently and quickly detecting the indoor air pollution sources in various indoor field, effectively removing the indoor air pollution to form a clean and safe breathing gas state, instantly monitoring the indoor air quality anytime and anywhere, and quickly purifying the indoor air when the indoor air quality is poor. The main subjects of research and development of the disclosure are to intelligently generate an air convection in the indoor space, quickly detect and determine the location of air pollution field, use the location to effectively control multiple filtering devices to implement the intelligent air convection to accelerate the directional flow of the air pollution, filter and remove the indoor air pollution sources, and make the indoor air pollution treatment of positioning the air pollution positioning-guiding the air pollution guiding-purifying the air pollution completely, whereby a clean and safe breathing gas state is achieved.

SUMMARY OF THE INVENTION

One object of the present disclosure is to provide an indoor air pollution prevention system. Since the indoor air pollution occurs and moves at any time, the indoor air pollution prevention system of the present disclosure includes a plurality of gas detectors arranged in various indoor fields and outdoor field. With the arrangement, the gas detector determines a characteristic, a concentration and a location of an air pollution, and outputs to form air pollution data. Furthermore, the gas exchange device includes an intake channel communicated to an intake filter device and an exhaust channel communicated to an exhaust filter device. The cloud computing service device receives the air pollution data detected in the indoor field unit and the outdoor field unit, stores the air pollution data in an air pollution database, implements an artificial intelligence calculation to determine the location of the air pollution, and issues a control command to the intake filter device and the exhaust filter device to control activation operations of the intake filter device and the exhaust filter device. In that, the indoor gas and the outdoor gas are intelligently selected for exchange, and a directional airflow is generated in the indoor field unit to quickly guide the air pollution to the filter element for filtering and removal completely. Thereby, the indoor air pollution treatment of positioning the air pollution-guiding the air pollution-purifying the air pollution completely is formed for the detection, purification and prevention effects.

In accordance with an aspect of the present disclosure, an indoor air pollution prevention system is provided and includes at least one indoor field unit, a gas exchange device, an intake filter device, an exhaust filter device, a plurality of gas detectors, and a cloud computing service device. The indoor field unit is a space surrounded and isolated by a plurality of partitions. The gas exchange device exchanges indoor gas and outdoor gas, and includes at least one intake channel and at least one exhaust channel. The intake channel and the exhaust channel are communicated to the indoor field unit, the intake channel is constructed in the indoor field unit for inhaling the outdoor gas, and the exhaust channel is constructed in the indoor field unit for discharging the indoor gas. The intake filter device is embedded at one port position where the intake channel is communicated and constructed in the partition of the indoor field unit. The intake filter device includes at least one fan, at least one filter element and a gate. When the fan is activated and the gate is opened at the same time, the outdoor gas in the intake channel is guided by the fan, to pass through the filter element for filtration and removal and enter the indoor field unit. The exhaust filter device is embedded at one port position where the exhaust channel is communicated and constructed in the partition of the indoor field unit. The exhaust filter device includes at least one fan, at least one filter element and a gate. When the fan is activated and the gate is opened at the same time, the indoor gas in the indoor field unit is guided by the fan, to enter the exhaust channel, pass through the filter element for filtration and removal and be discharged out. The plurality of gas detectors are disposed in each of the indoor field unit for detecting a characteristic, a concentration and a location of an air pollution, and outputting to form air pollution data. The cloud computing service device, receives the air pollution data detected in each of the indoor field unit, stores the air pollution data in an air pollution database, implements an artificial intelligence calculation to determine the location of the air pollution, and issues a control command to the indoor field unit with the air pollution generated. An activation operation of the fan of the exhaust filter device in the indoor field unit is controlled, and the gate is opened at the same time, whereby a directional airflow is generated, and the air pollution in the indoor field unit is guided quickly to the filter element of the exhaust filter device for filtering and removal, so that the air pollution in the indoor field unit is cleaned to reach a gas state of complete purification.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
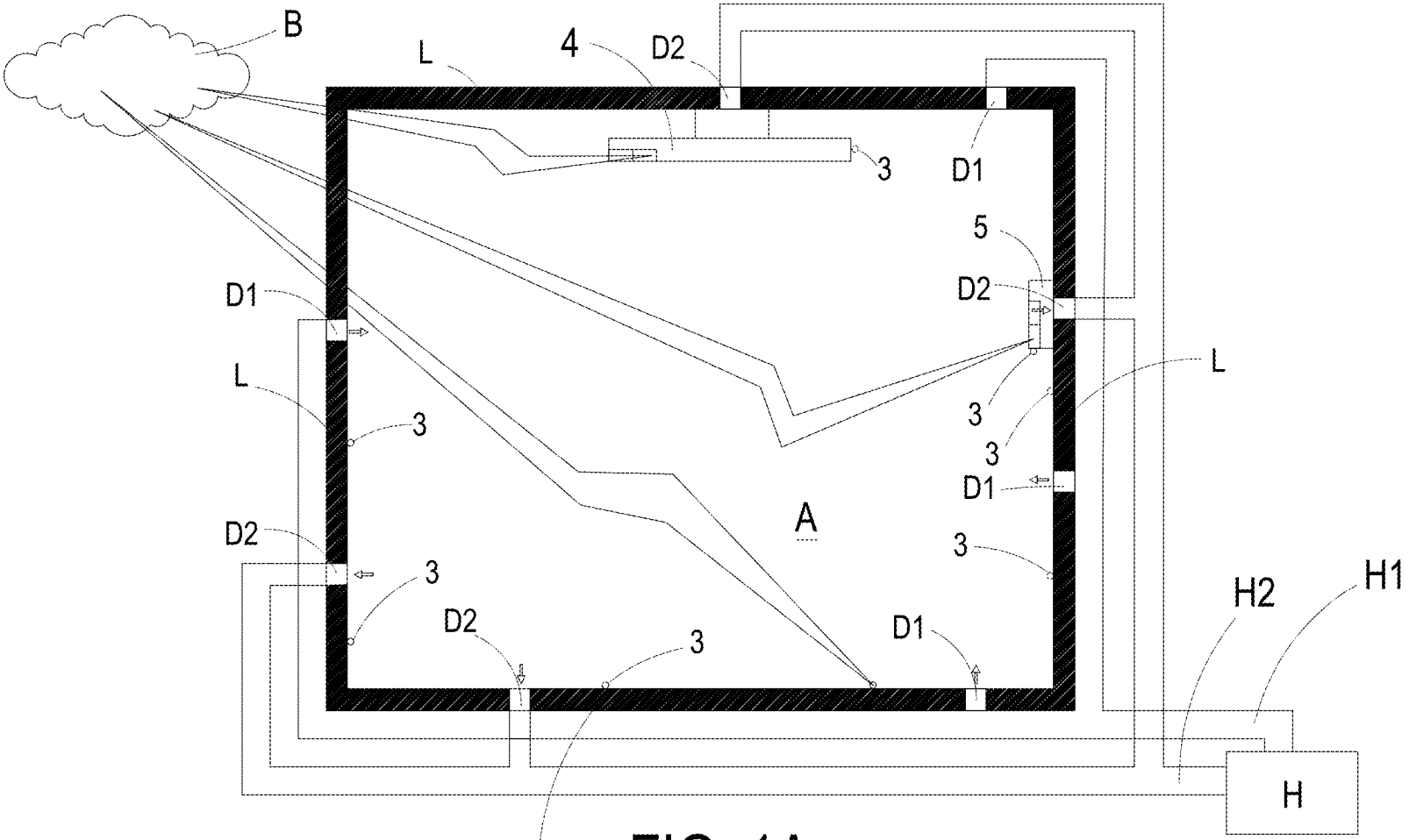
FIG. 1A is a schematic view illustrating an indoor air pollution prevention system used in an indoor field unit according to a preferred embodiment of the present disclosure.
Figure 1B:
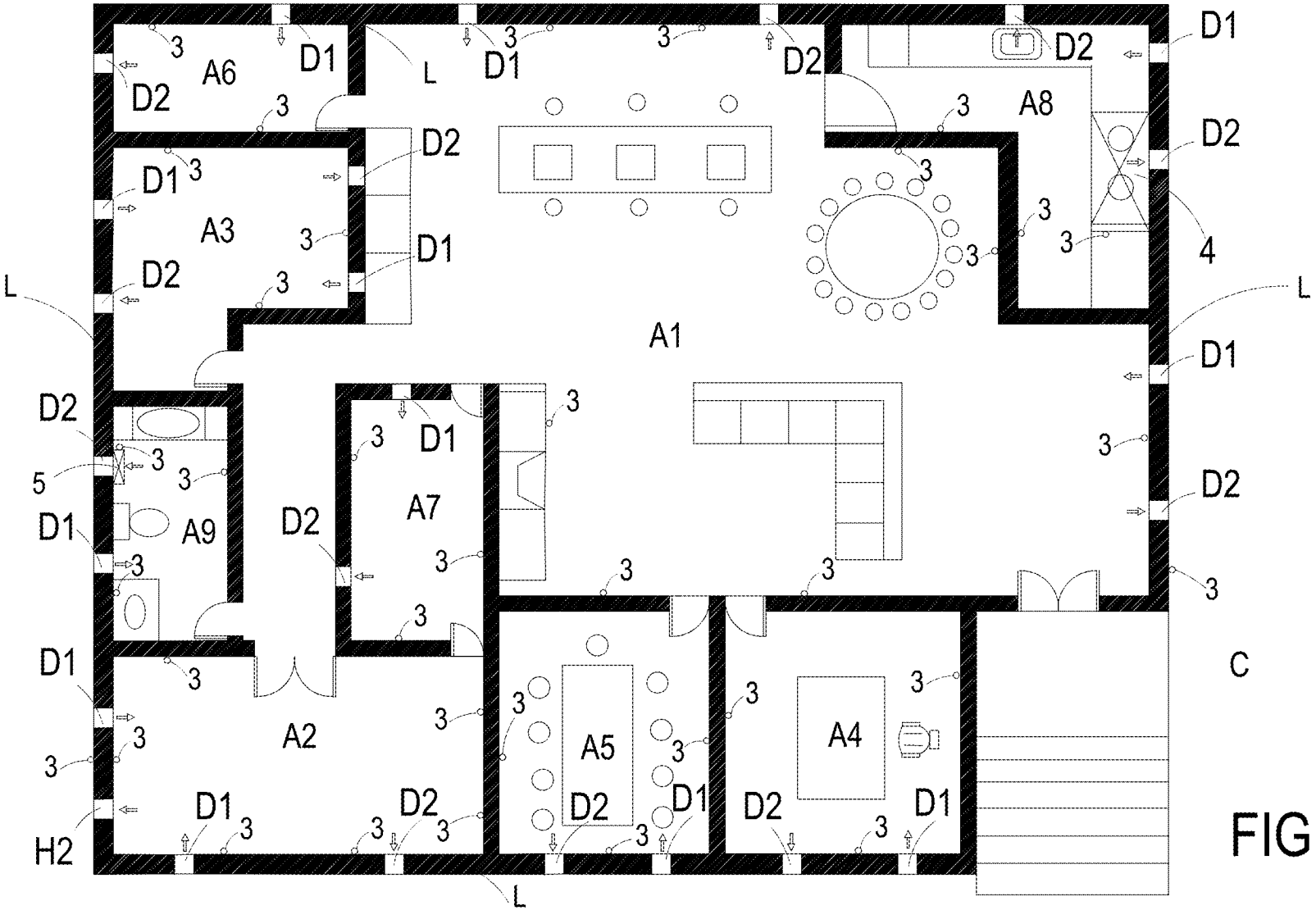
FIG. 1B is a schematic view illustrating an indoor air pollution prevention system used in a plurality of indoor field units according to a preferred embodiment of the present disclosure.

Please refer to FIG. 1A and FIG. 1B. The present disclosure provides an indoor air pollution prevention system includes at least one indoor field unit A, a gas exchange device H, a plurality of gas detectors 3 and a cloud computing service device B.

In the embodiment, the indoor field unit A is a space surrounded and isolated by a plurality of partitions L. Preferably but not exclusively, in the embodiment, the indoor field unit A is an indoor space formed in a general residential building, and includes a living room A1, a bedroom A2, family room A3, an office A4, a conference room A5, a tea room A6, dressing room A7, a kitchen A8, and a bathroom A9 (as shown in FIG. 1B). Preferably but not exclusively, the indoor field unit A of the indoor air pollution prevention system of the present invention includes all spaces separated in the indoor. In some embodiments, the indoor field unit A is an indoor space formed in a public building, including gymnasium, a concert hall, a theater, an exhibition space, a hospital spaces, an airport space and a station spaces, but limited thereto.

Figure 2A:
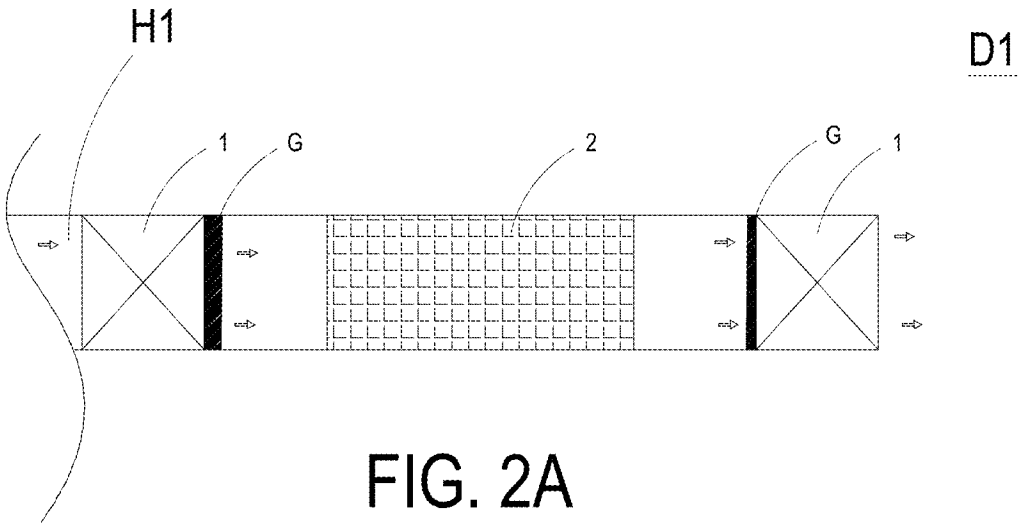
FIG. 2A is a schematic view illustrating the combination of the intake filter device in the intake channel of the indoor air pollution prevention system according to the embodiment of the present disclosure.
Figure 2B:
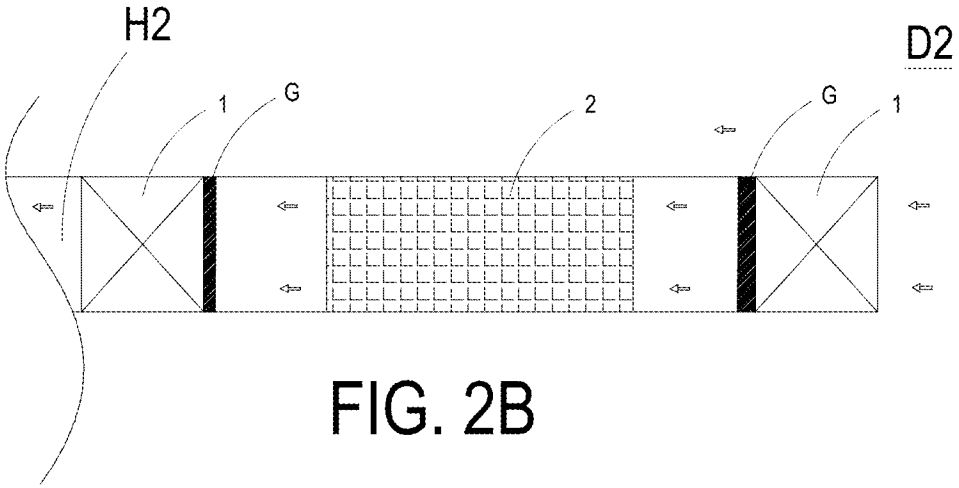
FIG. 2B is a schematic view illustrating the exhaust filter device in the exhaust channel of the indoor air pollution prevention system according to the embodiment of the present disclosure.

In the embodiment, the gas exchange device H is configured to exchange indoor gas and outdoor gas, and includes at least one intake channel H1 and at least one exhaust channel H2. Preferably but not exclusively, the intake channel H1 and the exhaust channel H2 are communicated to the indoor field unit A, the intake channel H1 is constructed in the indoor field unit A for inhaling the outdoor gas, and the exhaust channel H2 is constructed in the indoor field unit A for discharging the indoor gas. Notably, the intake filter device D1 is embedded at one port position where the intake channel H1 is communicated and constructed in the partition L of the indoor field unit A, as shown in FIG. 2A. Preferably but not exclusively, the intake filter device D1 includes at least one fan 1, at least one filter element 2 and a gate G. When the fan 1 is activated and the gate G is opened at the same time, the outdoor gas in the intake channel H1 is guided by the fan 1, to pass through the filter element 2 for filtration and removal and enter the indoor field unit A. The exhaust filter device D2 is embedded at one port position where the exhaust channel H2 is communicated and constructed in the partition L of the indoor field unit A, as shown in FIG. 2B. The exhaust filter device D2 includes at least one fan 1, at least one filter element 2 and a gate G. When the fan 1 is activated and the gate G is opened at the same time, the indoor gas in the indoor field unit A is guided by the fan 1, to enter the exhaust channel H2, pass through the filter element 2 for filtration and removal and be discharged out.

In the embodiment, the fan 1 has the functions of pumping or supplying air to transport gas in two directions. In the embodiment, the direction of the airflow path for pumping and supplying is indicated by the arrow for illustration (such as the direction indicated by the arrow shown in FIG. 2A). Preferably but not exclusively, the fan 1 is disposed at the front side of the filter element 2, or the fan 1 is disposed at the rear side of the filter element 2. As shown in FIG. 2A, the fans 1 are arranged at the front and rear sides of the filter element 2. Notably, as shown in FIG. 2A and FIG. 2B, in the embodiment, there are two fans 1 arranged at the front and rear sides of the filter element 2, but not limited thereto. Notably, as shown in FIG. 2A, the intake filter device D1 is embedded in the intake channel H1. Preferably but not exclusively, the fan 1 and the filter element 2 of the intake filter device D1 can be replaced, updated and maintained. Moreover, as shown in FIG. 2B. the exhaust filter device D2 is embedded in the exhaust channel H2. Preferably but not exclusively, the fan 1 and the filter element 2 of the exhaust filter device D2 can be replaced, updated and maintained.

Figure 2C:
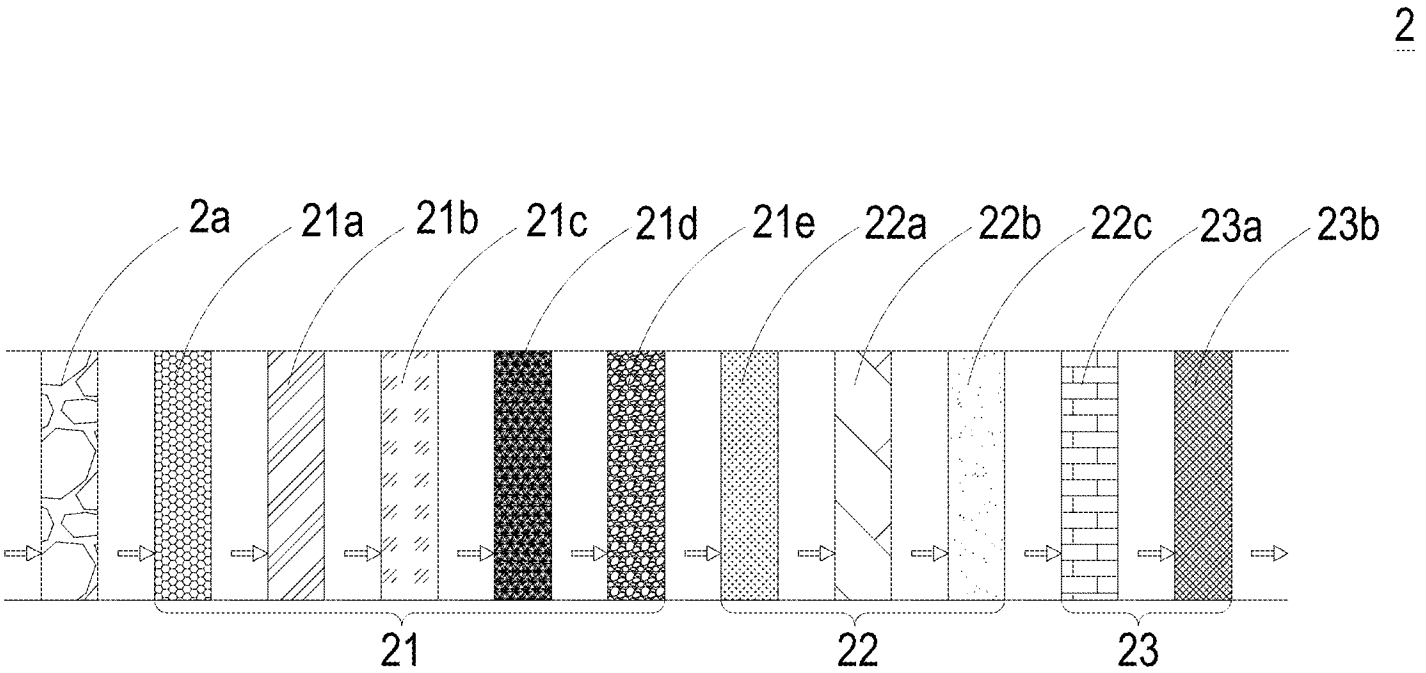
FIG. 2C is a schematic view illustrating the filter element according to the embodiment of the present disclosure.
Figure 3A:
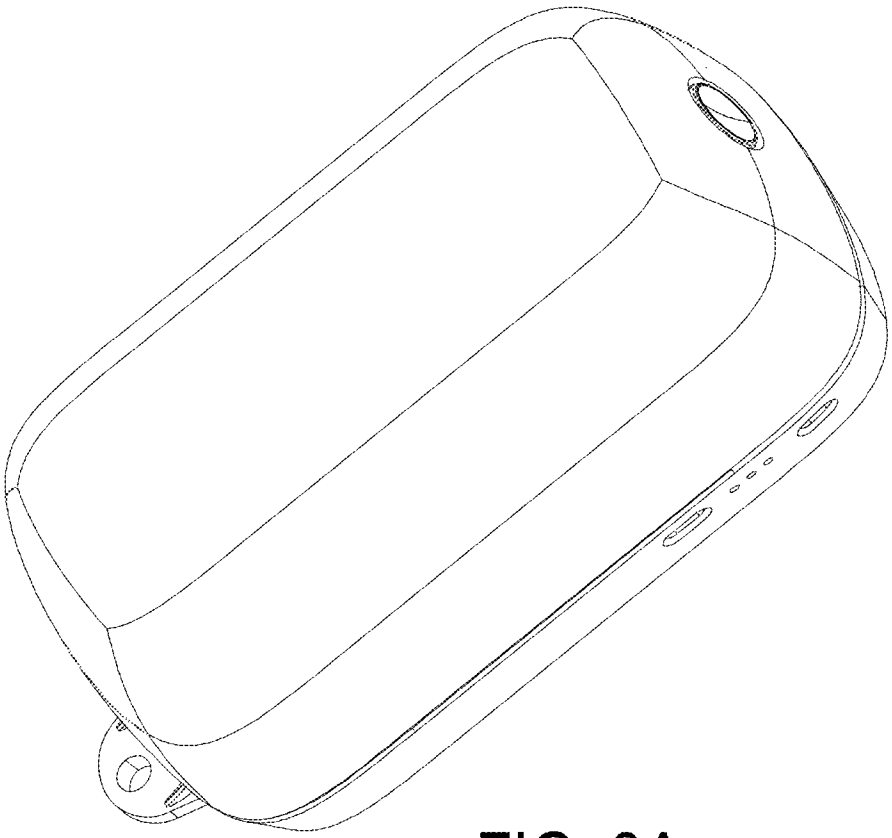
FIG. 3A is a schematic perspective view illustrating the gas detector according to the embodiment of the present disclosure.
Figure 3B:
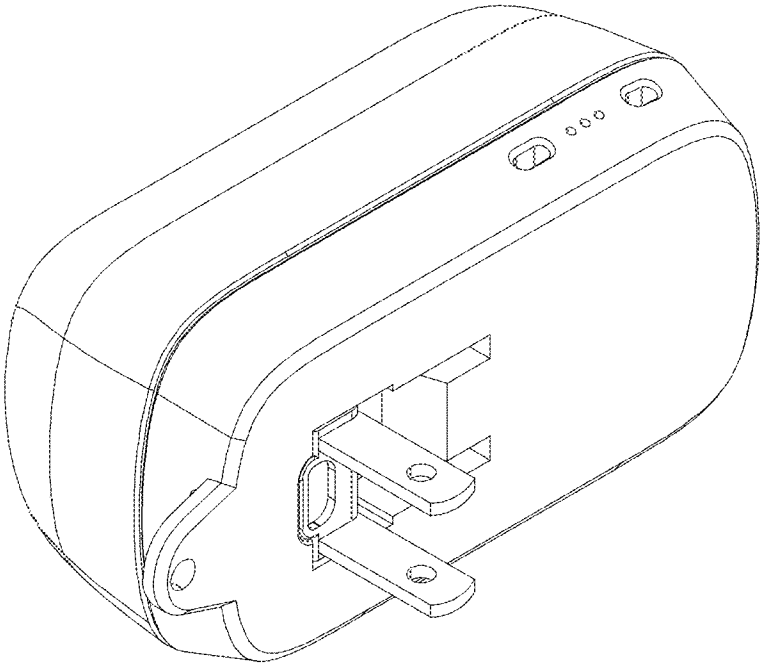
FIG. 3B is a schematic perspective view illustrating the gas detector according to the embodiment of the present disclosure and taken from another perspective.
Figure 3C:
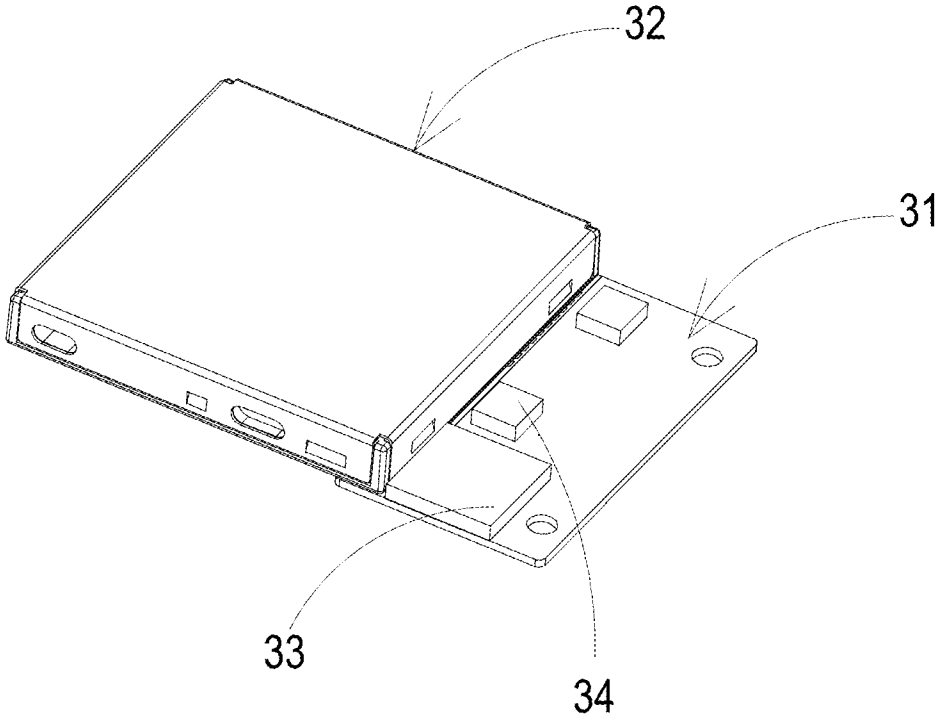
FIG. 3C is a schematic perspective view illustrating the gas detection module installed inside the gas detector according to the embodiment of the present disclosure.
Figure 4A:
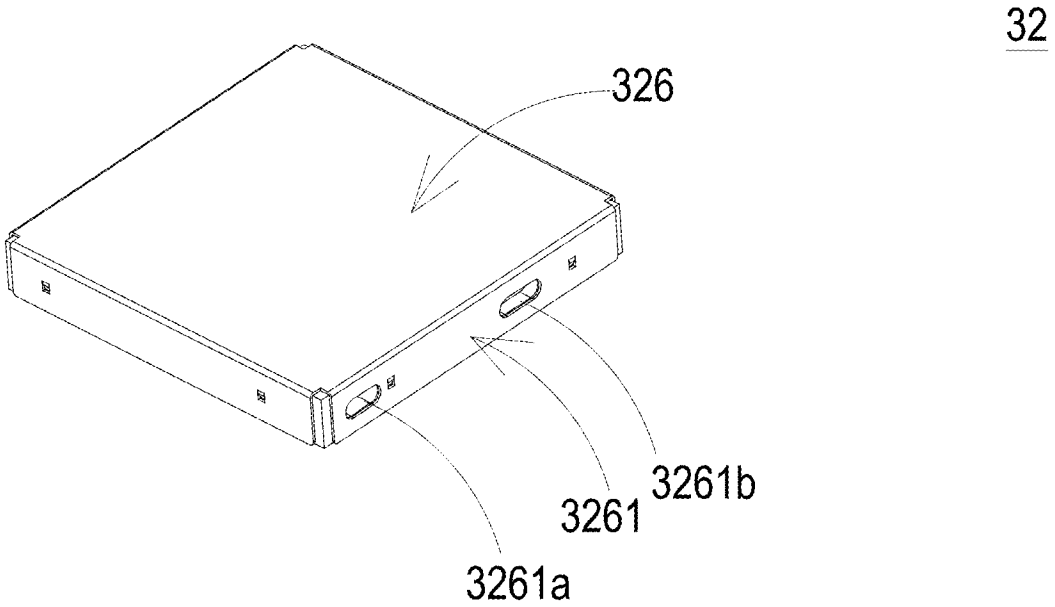
FIG. 4A is a schematic perspective view (1) illustrating the gas detection main part according to the embodiment of the present disclosure.
Figure 4B:
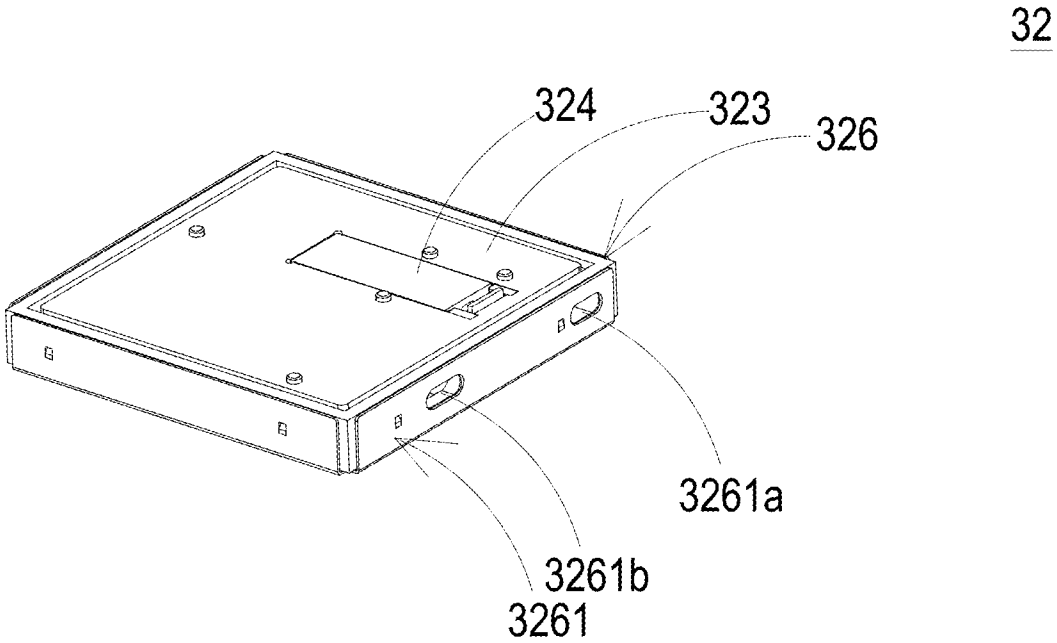
FIG. 4B is a schematic perspective view (2) illustrating the gas detection main part according to the embodiment of the present disclosure.
Figure 4C:
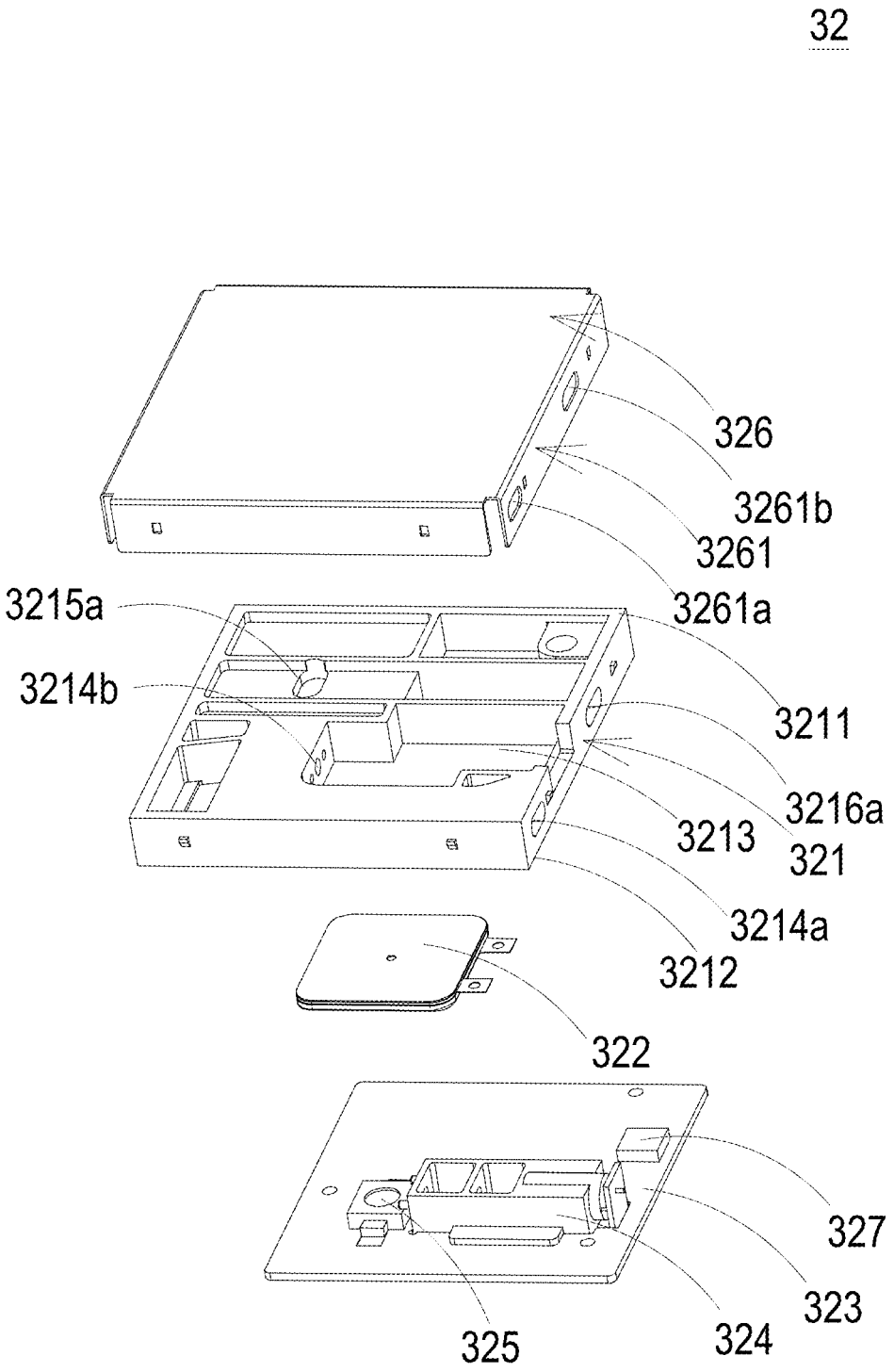
FIG. 4C is an exploded view illustrating the gas detector according to the embodiment of the present disclosure.
Figure 5A:
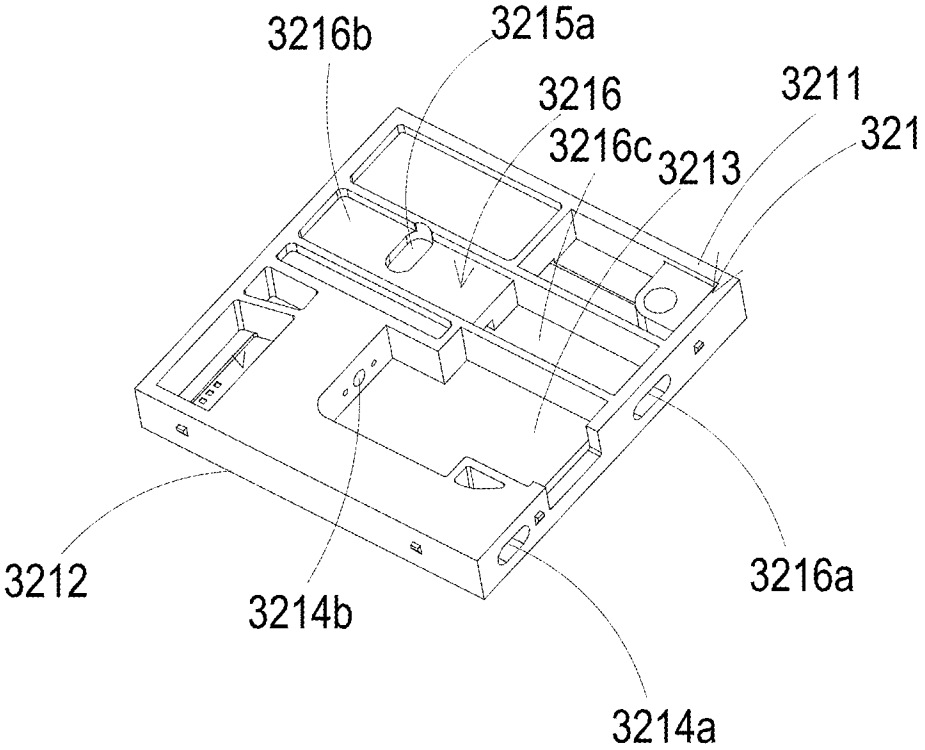
FIG. 5A is a schematic perspective view (1) illustrating the base according to the embodiment of the present disclosure.
Figure 5B:
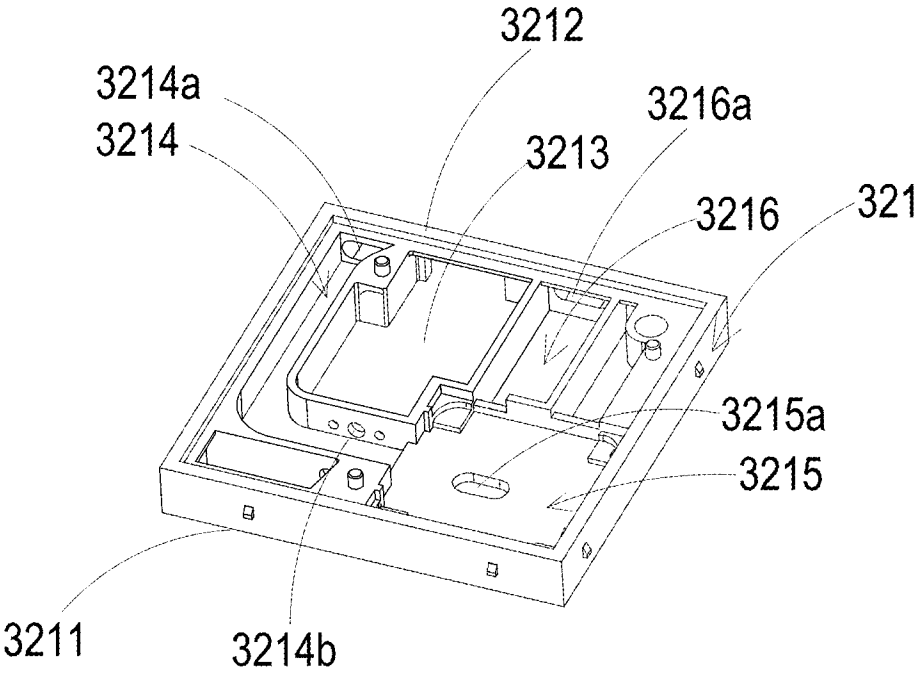
FIG. 5B is a schematic perspective view (2) illustrating the base according to the embodiment of the present disclosure.
Figure 6:
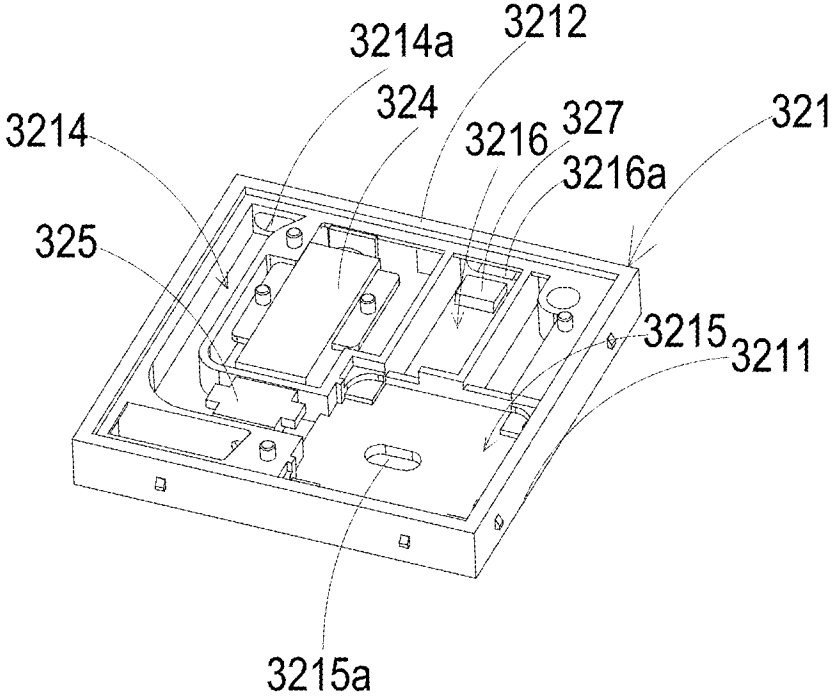
FIG. 6 is a schematic view (3) illustrating the base according to the embodiment of the present disclosure.
Figure 7A:
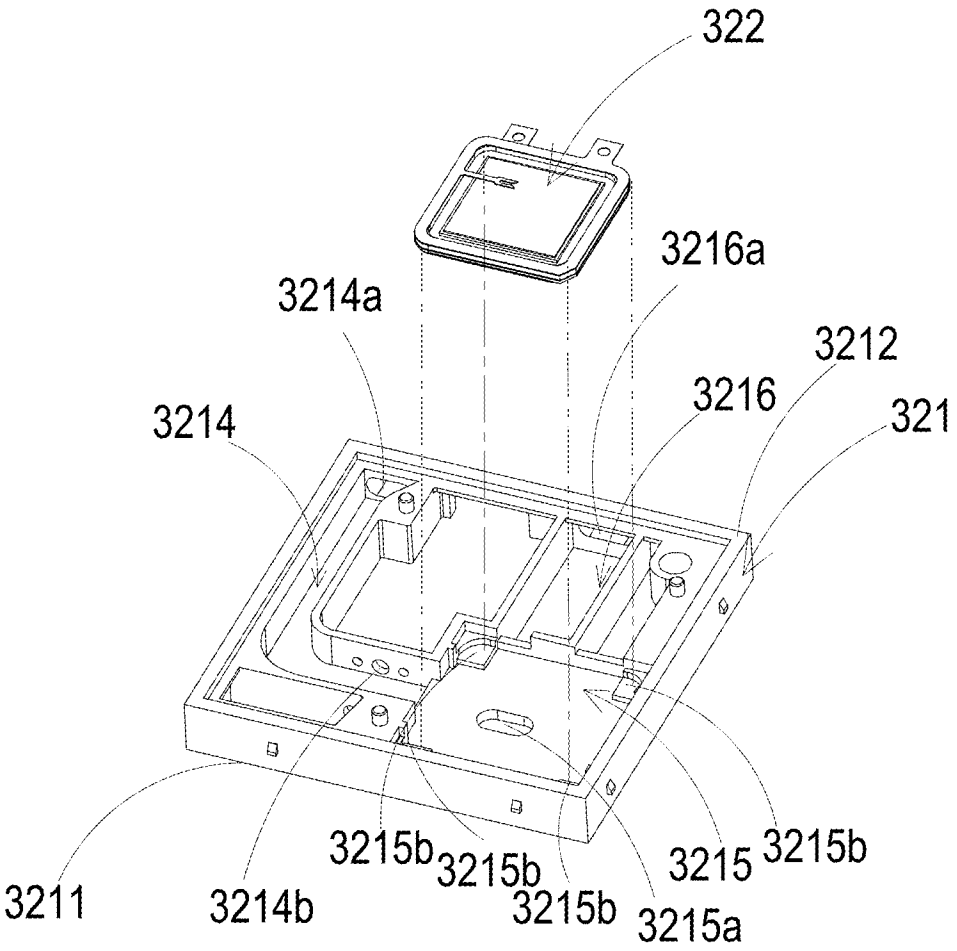
FIG. 7A is a schematic exploded view illustrating the combination of the piezoelectric actuator and the base according to the embodiment of the present disclosure.
Figure 7B:
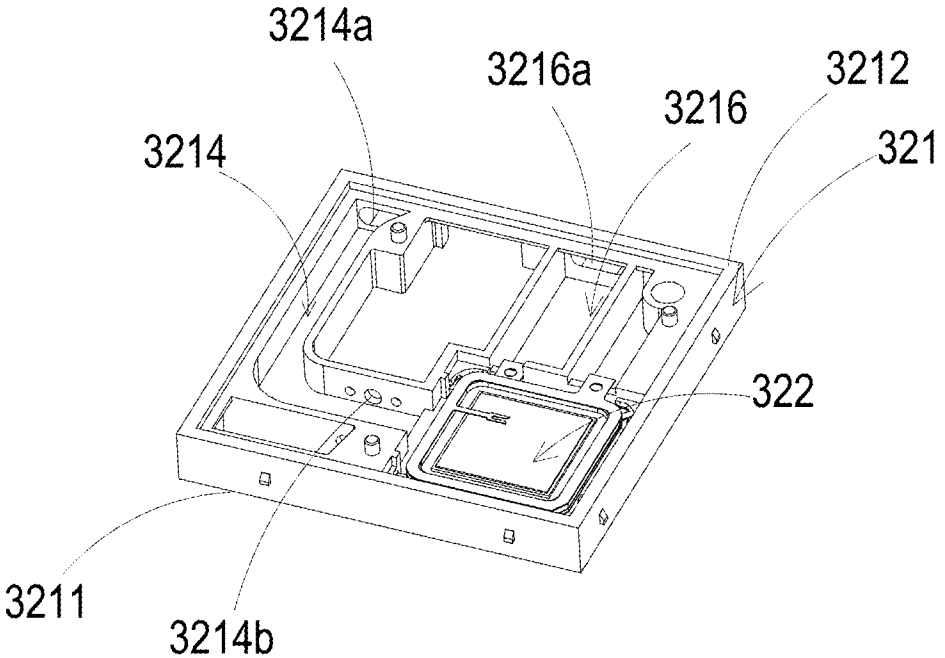
FIG. 7B is a schematic perspective view illustrating the combination of the piezoelectric actuator and the base according to the embodiment of the present disclosure.
Figure 8A:
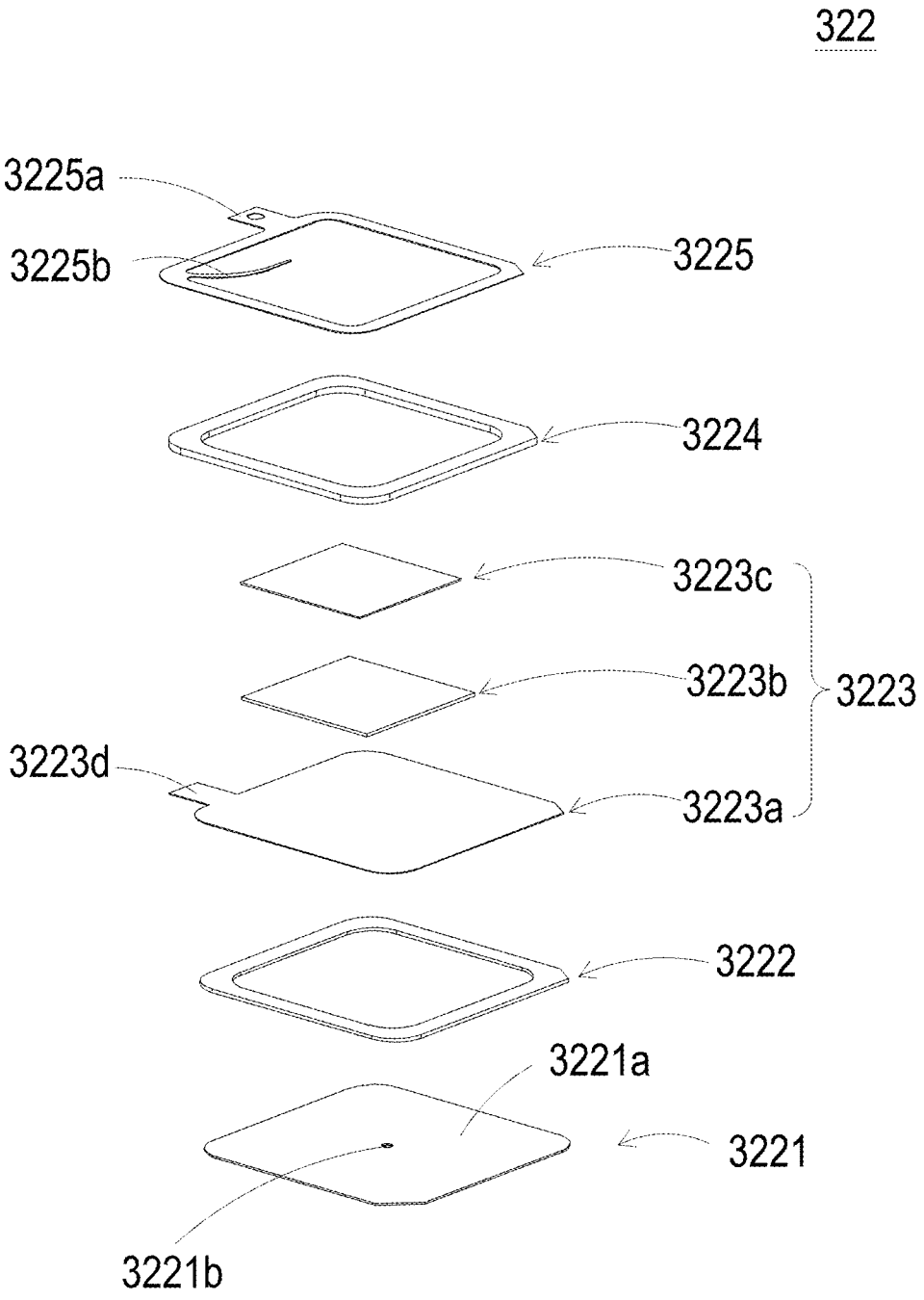
FIG. 8A is a schematic exploded view (1) illustrating the piezoelectric actuator according to the embodiment of the present disclosure.
Figure 8B:
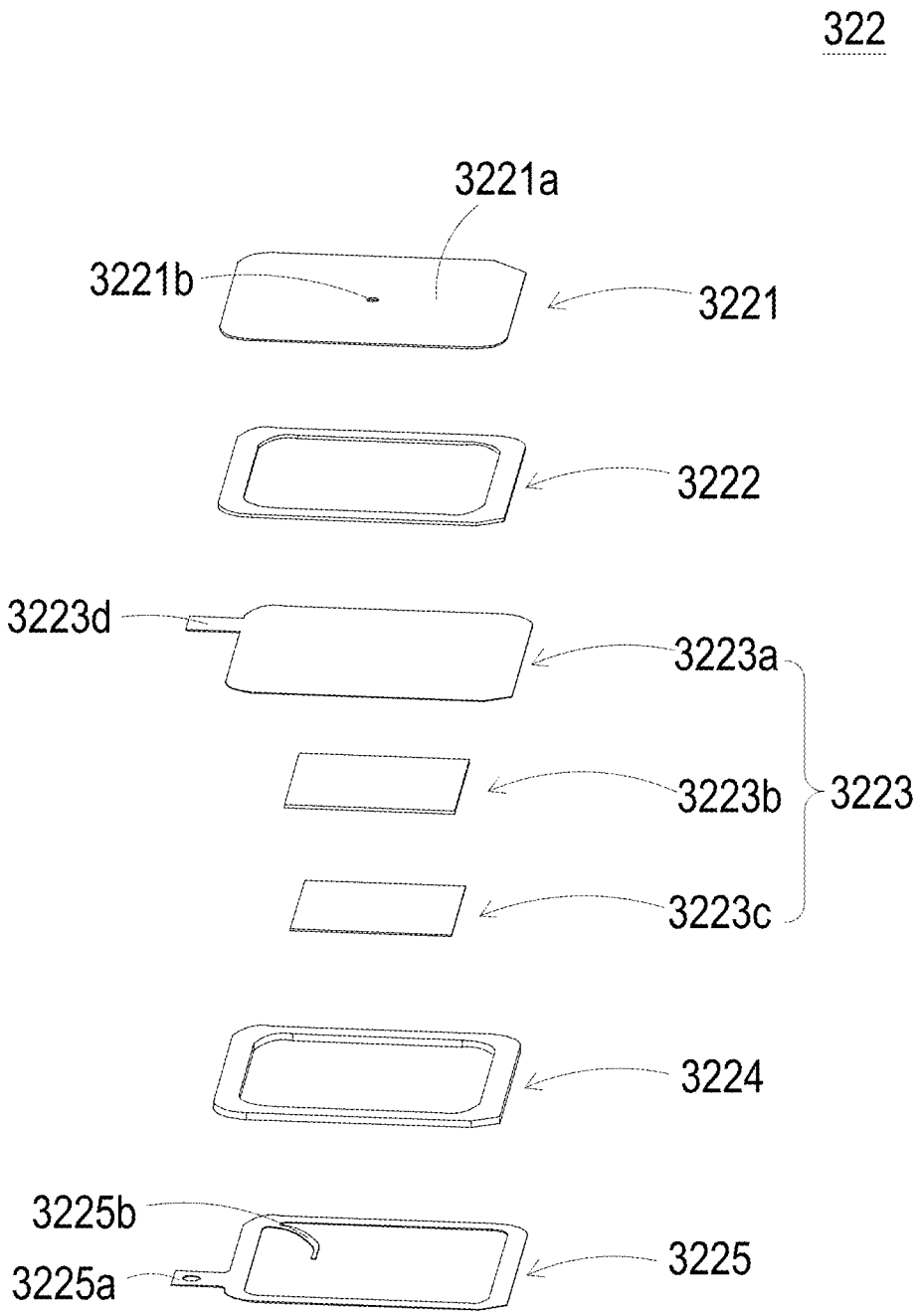
FIG. 8B is a schematic exploded view (2) illustrating the piezoelectric actuator according to the embodiment of the present disclosure.

Please refer to FIG. 2C. In the embodiment, the filter element 2 is a filter screen to clean the air pollution through a physical way of blocking and absorbing. Preferably but not exclusively, the filter screen is a high efficiency particulate air (HEPA) filter screen 2*a*, which is configured to absorb the chemical smoke, the bacteria, the dust particles and the pollen contained in the air pollution, so that the air pollution introduced is filtered and purified to achieve the effect of filtering and purification. Preferably but not exclusively, the filter element 2 is a high HEPA filter screen 2*a* coated with decomposition layer 21 to clean the air pollution through a chemical way. Preferably but not exclusively, the decomposition layer 21 includes an activated carbon 21*a* configured to remove organic and inorganic substances in air pollution, and remove colored and odorous substances. Preferably but not exclusively, the decomposition layer 21 includes a cleansing factor containing chlorine dioxide layer 21*b* configured to inhibit viruses, bacteria, fungi, influenza A, influenza B, enterovirus and norovirus in the air pollution, and the inhibition ratio can reach 99% and more, thereby reducing the cross-infection of viruses. Preferably but not exclusively, the decomposition layer 21 includes an herbal protective layer 21*c* extracted from ginkgo and Japanese *Rhus chinensis* configured to resist allergy effectively and destroy a surface protein of influenza virus (such as H1N1 influenza virus) passing therethrough. Preferably but not exclusively, the decomposition layer 21 includes a silver ion 21*d* configured to inhibit viruses, bacteria and fungi contained in the air pollution. Preferably but not exclusively, the decomposition layer 21 includes a zeolite 21*e* configured to remove ammonia nitrogen, heavy metals, organic pollutants, Escherichia coli, phenol, chloroform and anionic surfactants. In some embodiments, the filter element 2 is a high HEPA filter screen 2*a* combined with a light irradiation element 22 to clean the air pollution through a chemical way. Preferably but not exclusively, the light irradiation element 22 is a photo-catalyst unit including a photo catalyst 22*a* and an ultraviolet lamp 22*b*. When the photo catalyst 22*a* is irradiated by the ultraviolet lamp 22*b*, the light energy is converted into the chemical energy, thereby decomposes harmful gases and disinfects bacteria contained in the air pollution, so as to achieve the effects of filtering and purifying. Preferably but not exclusively, the light irradiation element 22 is a photo-plasma unit including a nanometer irradiation tube 22*c*. When the introduced air pollution is irradiated by the nanometer irradiation tube 22*c*, the oxygen molecules and water molecules contained in the air pollution are decomposed into high oxidizing photo-plasma, and an ion flow capable of destroying organic molecules is generated. In that, volatile formaldehyde, volatile toluene and volatile organic compounds (VOC) contained in the air pollution are decomposed into water and carbon dioxide, so as to achieve the effects of filtering and purifying. In some embodiments, the filter element 2 is a high HEPA filter screen 2*a* combined with a decomposition unit 23 to clean the air pollution through a chemical way. Preferably but not exclusively, the decomposition unit is a negative ion unit 23*a* with s a dust collecting plate. It makes the suspended particles in the air pollution to carry with positive charge and adhered to the dust collecting plate carry with negative charges, so as to achieve the effects of filtering and purifying. Preferably but not exclusively, the decomposition unit is a plasma ion unit 23*b*. The oxygen molecules and water molecules contained in the air pollution are decomposed into positive hydrogen ions ($H^+$) and negative oxygen ions ($O^{2-}$) by the plasma ion. The substances attached with water around the ions are adhered on the surface of viruses and bacteria and converted into OH radicals with extremely strong oxidizing power, thereby removing hydrogen (H) from the protein on the surface of viruses and bacteria, and thus decomposing (oxidizing) the protein, so as to filter the introduced air pollution and achieve the effects of filtering and purifying.

Please refer to FIG. 1B. In the embodiment, there are the plurality of gas detectors 3. At least one of the gas detectors 3 is disposed in the outdoor field unit C. The gas detector 3 in the outdoor field unit C is used for detecting a characteristic, a concentration and a location of an air pollution, and outputting to form air pollution data. Moreover, at least one of the gas detectors 3 is disposed in the indoor field unit A. The gas detector 3 in the indoor field unit A is used for detecting a characteristic, a concentration and a location of an air pollution, and outputting to form air pollution data.

Please refer to FIG. 1A, FIG. 1B, FIG. 3A and FIG. 3B. Each of the plurality of gas detectors 3 disposed in the indoor field unit A and the outdoor field unit C detects the characteristic, the concentration and the location of the air pollution, and outputs to form the air pollution data detected in the indoor field unit A and the outdoor field unit C. The filter element 2 filters the air pollution in air passing therethrough. The fan 1 guides the air pollution to pass through the filter element 2 for filtering and removal. The cloud computing service device B receives the air pollution data detected in the indoor field unit A and the outdoor field unit C, stores the air pollution data in an air pollution database, implements an artificial intelligence calculation to determine the location of the air pollution, and issuing a control command to the plural of exhaust filter devices D2 in the indoor field unit A. Whereby, the activation operation of the fan 1 of the exhaust filter device D2 closest to the location of the air pollution in the indoor field unit A is controlled, and the gate G is opened at the same time. Moreover, a directional airflow is generated, the air containing the air pollution in the indoor field unit A is guided quickly to the filter elements 2 of the plurality of exhaust filter devices S2 for filtering and removal, and the indoor field unit A reaches a gas state of complete purification.

Notably, in the above embodiment, the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

Figure 12:
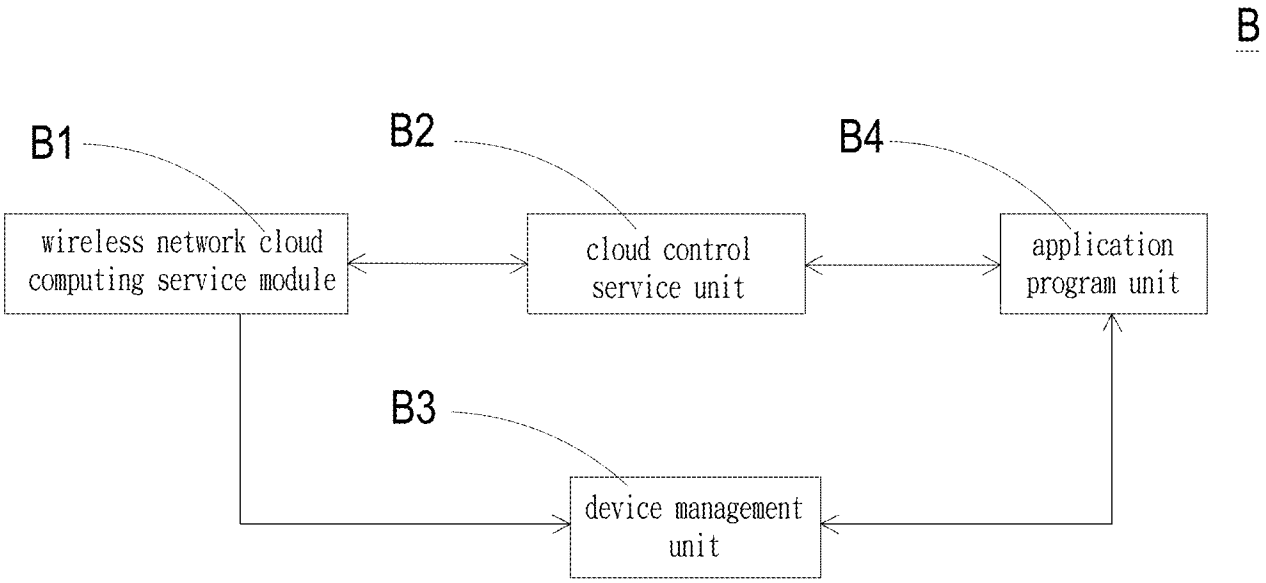
FIG. 12 is a schematic diagram of the architecture of the cloud computing service device according to the embodiment of the present disclosure.

Please refer to FIG. 12. In the embodiment, the cloud computing server device B includes a wireless network cloud computing service module B1, a cloud control service unit B2, a device management unit B3 and an application program unit B4. The wireless network cloud computing service module B1 receives the air pollution data detected in the indoor field unit A, receives the communication information of the fan 1 and transmits the control commands. Moreover, the wireless network cloud computing service module B1 receives the air pollution data detected in the indoor field unit A and transmits the air pollution data to the cloud control service unit B2 to store and form an air pollution database. An artificial intelligence calculation is implemented to determine the location of the air pollution through the air pollution database comparison, so that the control commend is transmitted to the wireless network cloud computing service module B1, and then transmitted to the fans 1 of the intake filter device D1 and the exhaust filter device D2 to control the actuation operations through the wireless network cloud computing service module B1. At the same time, the gates G are opened. Moreover, the device management unit B3 receives the communication information of the fan 1 through the wireless network cloud computing service module B1 to manage the user login and device binding. The device management information can be provided to the application program unit B4 for system control and management, and the application program unit B4 can also display and inform the air pollution data obtained by the cloud control service unit B2. The user can know the real-time status of air pollution removal through the mobile phone or the communication device. Moreover, the user can control the operation of the indoor air pollution prevention system through the application program unit B4 of the mobile phone or the communication device.

From the above, the plurality of gas detectors 3 are disposed in the indoor field unit A to detect the characteristics and the concentrations of the air pollution. Preferably but not exclusively, the indoor field unit A is one selected from the group consisting of a living room A1, a bedroom A2, a family room A3, an office A4, a conference room A5, a tea room A6, a dressing room A7, a gymnasium, a concert hall, a theater, an exhibition space, a hospital space, an airport space, a station space and a combination thereof. The cloud computing service device B receives and compares the air pollution data detected by the plurality of gas detectors 3 in the indoor field unit A and the outdoor field unit C. If the air pollution data detected in the indoor field unit A is higher than the air pollution data detected in the outdoor field unit C, the cloud computing service device B issues the control command to the fans 1 of the intake filter device D1 and the exhaust filter device D2 for the activation operation, the gates G are opened while the fans 1 are activated, the air in the outdoor field unit C is introduced through the intake channel H1 and enters into the indoor field unit A, and the air pollution in the indoor field unit is A guided to the exhaust channel H2 for filtering and removal to the outdoor field unit C. Thereby, the air in the indoor field unit A is exchanged to reach the gas state of complete purification.

Figure 1C:
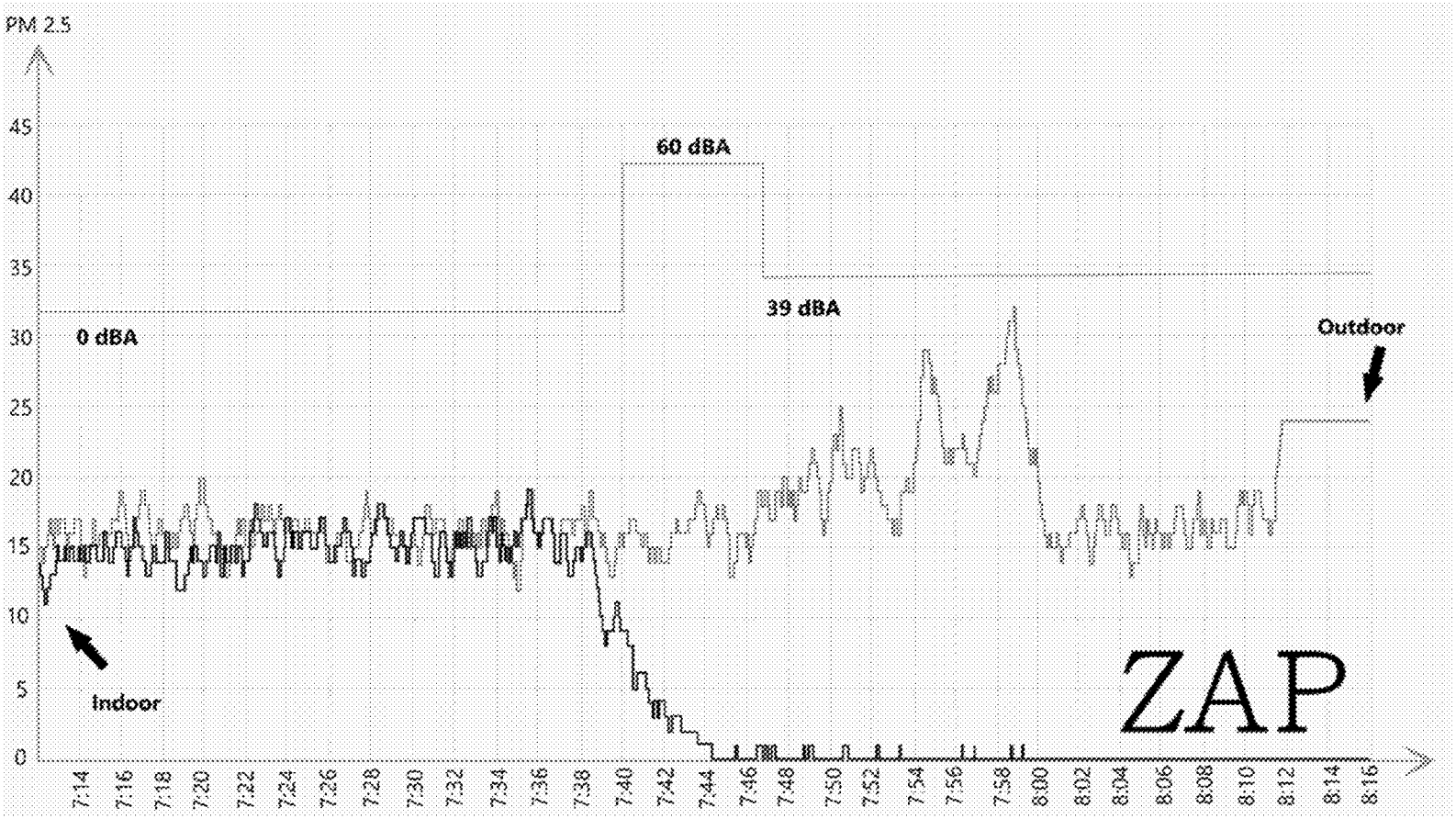
FIG. 1C is an air pollution removal curve illustrating the indoor air pollution prevention system used in the indoor field unit according to the preferred embodiment of the present disclosure.

Preferably but not exclusively, the indoor field unit A is one selected from the group consisting of a living room A1, a bedroom A2, a family room A3, an office A4, a conference room A5, a tea room A6, a dressing room A7, a gymnasium, a concert hall, a theater, an exhibition space, a hospital space, an airport space, a station space and a combination thereof. The cloud computing service device B receives and compares at least two or more of the air pollution data detected by the plurality of gas detectors 3 in the indoor field unit A, intelligently calculates to position the location of the air pollution in the indoor field unit A, and intelligently selects to issue the control command to the fan 1 of the exhaust filter device D2. In that, the fan 1 closest to the location of the air pollution is enabled for the activation operation firstly, then other fans 1 are enabled for the activation operation, and the directional airflow is generated to guide the air pollution to the filter element 2 for filtering and removal. Thereby, the air pollution in the indoor field unit A is cleaned quickly to reach the gas state of complete purification. As shown in FIG. 1C, the gas detector 3 installed in the indoor field unit A for detecting suspended particles PM2.5 is taken as an example. Before the user activates the indoor air pollution prevention system at 7:40, the PM2.5 value of suspended particulate matter detected in the indoor field unit A is similar to the PM2.5 value of suspended particulate matter detected in the outdoor field unit C. When the indoor air pollution prevention system is activated at 7:40, the gas detector 3 in the indoor field unit A detects the air pollution data of suspended particulate matter PM2.5, and the cloud computing service device B receives and compares at least two or more of the air pollution data detected by the plurality of gas detectors 3 in the indoor field unit A, intelligently calculates to position the location of the air pollution in the indoor field unit A, and intelligently selects to issue the control command to the fan 1. In that, the fan 1 closest to the location of the air pollution is enabled for the activation operation firstly, then other fans 1 are enabled for the activation operation, and the gates G are opened at the same time. Whereby, the air pollution in the indoor field unit A is guided quickly to the filter elements 2 of the plurality for filtering and removal. At 7:44, it can be seen that the value of the air pollution data detected in the entire indoor field unit A is dropped rapidly, and the effect of air pollution complete purification is maintained thereafter.

Moreover, in an embodiment, the indoor field unit A is a kitchen field unit A8, the indoor field unit A includes a range hood 4, the range hood 4 is connected with the exhaust channel H2. The cloud computing service device B receives and compares the air pollution data detected by the gas detector 3 in the indoor field unit A. When the air pollution data exceeds a safety detection value, the control command is intelligently selected and issued to the range hood 4 for the activation operation, and the air pollution is quickly guided and discharged out, so that the air pollution in the indoor field unit A is cleaned to reach the gas state of complete purification. Notably, in the embodiment, the gas detector 3 is constructed on the range hood 4, and the air pollution data include detection values of oil smoke, VOC and polycyclic aromatic hydrocarbons. When the air pollution data detected exceeds a safety detection value, the control command is issued to the range hood 4 in the indoor field unit A for the actuation operation.

In an embodiment, the indoor field unit A is a bathroom field unit A9, the indoor field unit A includes an exhaust fan 5, and the exhaust fan 5 is connected with the exhaust channel H2. Moreover, the cloud computing service device B receives and compares the air pollution data detected by the gas detector 3 in the indoor field unit A. When the air pollution data exceeds a safety detection value, the control command is intelligently selected and issued to the exhaust fan 5 for the activation operation, and the air pollution is quickly guided and discharged out, so that the air pollution in the indoor field unit A is cleaned to reach the gas state of complete purification, and the temperature and the humidity of the indoor field unit A are controlled. Notably, the gas detector 3 is constructed on the exhaust fan 5, the air pollution data include detection values of $CO_2$, VOC, PM2.5, the temperature and the humidity. When the air pollution data detected exceeds a safety detection value, the control command is issued to the exhaust fan 5 in the indoor field unit A for the actuation operation.

Notably, in the above embodiments, the safety detection value includes at least one selected from the group consisting of a concentration of PM2.5 which is less than 15 $g/m^3$, a concentration of carbon dioxide which is less than 1000 ppm, a concentration of total volatile organic compounds (TVOC) which is less than 0.56 ppm, a concentration of formaldehyde (HCHO) which is less than 0.08 ppm, a colony-forming unit of bacteria which is less than 1500 $CFU/m^3$, a colony-forming unit of fungi which is less than 1000 $CFU/m^3$, a concentration of sulfur dioxide which is less than 0.075 ppm, a concentration of nitrogen dioxide which is less than 0.1 ppm, a concentration of carbon monoxide which is less than 9 ppm, a concentration of ozone which is less than 0.06 ppm, and a concentration of lead which is less than 0.15 $g/m^3$.

For understanding the implementation of the indoor air pollution prevention system of the present disclosure, the internal structure and function of the gas detector 3 will be described below.

Please refer to FIG. 3A to FIG. 11. In the present disclosure, the gas detector 3 is described with the symbol 3 below. The gas detector 3 includes a gas detection module disposed thereon. The gas detection module includes a controlling circuit board 31, a gas detection main part 32, a microprocessor 33 and a communicator 34. In the embodiment, the gas detection main part 32, the microprocessor 33 and the communicator 34 are integrally packaged on the controlling circuit board 31 and electrically connected to the controlling circuit board 31. The microprocessor 33 and the communicator 34 are disposed on the controlling circuit board 31, and the microprocessor 33 controls the detection of the gas detection main part 32. In that, the gas detection main part 32 detects the air pollution and outputs a detection signal, and the microprocessor receives and processes the detection signal to generate air pollution data and provides the air pollution data to the communicator 34 for a wireless communication transmission externally to the cloud computing service device B.

Please refer to FIG. 4A to FIG. 9A. In the embodiment, the gas detection main part 32 includes a base 321, a piezoelectric actuator 322, a driving circuit board 323, a laser component 324, a particulate sensor 325, and an outer cover 326. In the embodiment, the base 321 includes a first surface 3211, a second surface 3212, a laser loading region 3213, a gas-inlet groove 3214, a gas-guiding-component loading region 3215 and a gas-outlet groove 3216. The first surface 3211 and the second surface 3212 are two surfaces opposite to each other. In the embodiment, the laser loading region 3213 is hollowed out from the first surface 3211 toward the second surface 3212. The outer cover 326 covers the base 321 and includes a side plate 3261. The side plate 3261 has an inlet opening 3261*a* and an outlet opening 3261*b*. The gas-inlet groove 3214 is concavely formed from the second surface 3212 and disposed adjacent to the laser loading region 3213. The gas-inlet groove 3214 includes a gas-inlet 3214*a* and two lateral walls. The gas-inlet 3214*a* is in communication with an environment outside the base 321, and is spatially corresponding in position to an inlet opening 3261*a* of the outer cover 326. Two transparent windows 3214*b* are opened on the two lateral walls of the gas-inlet groove 3214 and are in communication with the laser loading region 3213. Therefore, the first surface 3211 of the base 321 is covered and attached by the outer cover 326, and the second surface 3212 is covered and attached by the driving circuit board 323, so that an inlet path is defined by the gas-inlet groove 3214.

In the embodiment, the gas-guiding-component loading region 3215 mentioned above is concavely formed from the second surface 3212 and in communication with the gas-inlet groove 3214. A ventilation hole 3215*a* penetrates a bottom surface of the gas-guiding-component loading region 3215. The gas-guiding-component loading region 3215 includes four positioning protrusions 3215*b* disposed at four corners of the gas-guiding-component loading region 3215, respectively. In the embodiment, the gas-outlet groove 3216 includes a gas-outlet 3216*a*, and the gas-outlet 3216*a* is spatially corresponding to the outlet opening 3261*b* of the outer cover 326. The gas-outlet groove 3216 includes a first section 3216*b* and a second section 3216*c*. The first section 3216*b* is concavely formed out from the first surface 3211 in a region spatially corresponding to a vertical projection area of the gas-guiding-component loading region 3215. The second section 3216*c* is hollowed out from the first surface 3211 to the second surface 3212 in a region where the first surface 3211 is extended from the vertical projection area of the gas-guiding-component loading region 3215. The first section 3216*b* and the second section 3216*c* are connected to form a stepped structure. Moreover, the first section 3216*b* of the gas-outlet groove 3216 is in communication with the ventilation hole 3215*a* of the gas-guiding-component loading region 3215, and the second section 3216*c* of the gas-outlet groove 3216 is in communication with the gas-outlet 3216*a*. In that, when first surface 3211 of the base 321 is attached and covered by the outer cover 326 and the second surface 3212 of the base 321 is attached and covered by the driving circuit board 323, the gas-outlet groove 3216 and the driving circuit board 323 collaboratively define an outlet path.

In the embodiment, the laser component 324 and the particulate sensor 325 are disposed on and electrically connected to the driving circuit board 323 and located within the base 321. In order to clearly describe and illustrate the positions of the laser component 324 and the particulate sensor 325 in the base 321, the driving circuit board 323 is intentionally omitted. The laser component 324 is accommodated in the laser loading region 3213 of the base 321, and the particulate sensor 325 is accommodated in the gas-inlet groove 3214 of the base 321 and is aligned to the laser component 324. In addition, the laser component 324 is spatially corresponding to the transparent window 3214*b*, therefore, a light beam emitted by the laser component 324 passes through the transparent window 3214*b* and is irradiated into the gas-inlet groove 3214. A light beam path emitted from the laser component 324 passes through the transparent window 3214*b* and extends in an orthogonal direction perpendicular to the gas-inlet groove 3214. In the embodiment, a projecting light beam emitted from the laser component 324 passes through the transparent window 3214*b* and enters the gas-inlet groove 3214 to irradiate the suspended particles contained in the gas passing through the gas-inlet groove 3214. When the suspended particles contained in the gas are irradiated and generate scattered light spots, the scattered light spots are received and calculated by the particulate sensor 325 to obtain the gas detection data. In addition, the gas sensor 327 is positioned and disposed on the driving circuit board 323, electrically connected to the driving circuit board 323, and accommodated in the gas-outlet groove 3216, so as to detect the air pollution introduced into the gas-outlet groove 3216. In a preferred embodiment, the gas sensor 327 is a volatile-organic-compound sensor, a formaldehyde sensor, a bacteria sensor, a virus sensor or a combination thereof, the volatile-organic-compound sensor is used for detecting gas information of carbon dioxide ($CO_2$) or volatile organic compounds (TVOC), the formaldehyde sensor is used for detecting gas information of formaldehyde (HCHO), the bacteria sensor is used for detecting gas information of bacteria or fungi, and the virus sensor used for detecting gas information of virus.

In the embodiment, the piezoelectric actuator 322 is accommodated in the square-shaped gas-guiding-component loading region 3215 of the base 321. In addition, the gas-guiding-component loading region 3215 of the base 321 is in fluid communication with the gas-inlet groove 3214. When the piezoelectric actuator 322 is enabled, the gas in the gas-inlet groove 3214 is inhaled by the piezoelectric actuator 322, so that the gas flows into the piezoelectric actuator 322, and is transported into the gas-outlet groove 3216 through the ventilation hole 3215*a* of the gas-guiding-component loading region 3215. Moreover, the driving circuit board 323 covers the second surface 3212 of the base 321, and the laser component 324 is disposed on the driving circuit board 323, and is electrically connected to the driving circuit board 323. The particulate sensor 325 is also disposed on the driving circuit board 323 and electrically connected to the driving circuit board 323. In that, when the outer cover 326 covers the base 321, the inlet opening 3261*a* is spatially corresponding to the gas-inlet 3214*a* of the base 321, and the outlet opening 3261*b* is spatially corresponding to the gas-outlet 3216*a* of the base 321.

In the embodiment, the piezoelectric actuator 322 includes a gas-injection plate 3221, a chamber frame 3222, an actuator element 3223, an insulation frame 3224 and a conductive frame 3225. In the embodiment, the gas-injection plate 3221 is made by a flexible material and includes a suspension plate 3221*a* and a hollow aperture 3221*b*. The suspension plate 3221*a* is a sheet structure and is permitted to undergo a bending deformation. Preferably but not exclusively, the shape and the size of the suspension plate 3221*a* are accommodated in the inner edge of the gas-guiding-component loading region 3215, but not limited thereto. The hollow aperture 3221*b* passes through a center of the suspension plate 3221*a*, so as to allow the gas to flow therethrough. Preferably but not exclusively, in the embodiment, the shape of the suspension plate 3221*a* is selected from the group consisting of a square, a circle, an ellipse, a triangle and a polygon, but not limited thereto.

In the embodiment, the chamber frame 3222 is carried and stacked on the gas-injection plate 3221. In addition, the shape of the chamber frame 3222 is corresponding to the gas-injection plate 3221. The actuator element 3223 is carried and stacked on the chamber frame 3222. A resonance chamber 3226 is collaboratively defined by the actuator element 3223, the chamber frame 3222 and the suspension plate 3221*a* and is formed between the actuator element 3223, the chamber frame 3222 and the suspension plate 3221*a*. The insulation frame 3224 is carried and stacked on the actuator element 3223 and the appearance of the insulation frame 3224 is similar to that of the chamber frame 3222. The conductive frame 3225 is carried and stacked on the insulation frame 3224, and the appearance of the conductive frame 3225 is similar to that of the insulation frame 3224. In addition, the conductive frame 3225 includes a conducting pin 3225*a* and a conducting electrode 3225*b*. The conducting pin 3225*a* is extended outwardly from an outer edge of the conductive frame 3225, and the conducting electrode 3225*b* is extended inwardly from an inner edge of the conductive frame 3225. Moreover, the actuator element 3223 further includes a piezoelectric carrying plate 3223*a*, an adjusting resonance plate 3223*b* and a piezoelectric plate 3223*c*. The piezoelectric carrying plate 3223*a* is carried and stacked on the chamber frame 3222. The adjusting resonance plate 3223*b* is carried and stacked on the piezoelectric carrying plate 3223*a*. The piezoelectric plate 3223*c* is carried and stacked on the adjusting resonance plate 3223*b*. The adjusting resonance plate 3223*b* and the piezoelectric plate 3223*c* are accommodated in the insulation frame 3224. The conducting electrode 3225*b* of the conductive frame 3225 is electrically connected to the piezoelectric plate 3223*c*. In the embodiment, the piezoelectric carrying plate 3223*a* and the adjusting resonance plate 3223*b* are made by a conductive material. The piezoelectric carrying plate 3223*a* includes a piezoelectric pin 3223*d*. The piezoelectric pin 3223*d* and the conducting pin 3225*a* are electrically connected to a driving circuit (not shown) of the driving circuit board 323, so as to receive a driving signal, such as a driving frequency and a driving voltage. Through this structure, a circuit is formed by the piezoelectric pin 3223*d*, the piezoelectric carrying plate 3223*a*, the adjusting resonance plate 3223*b*, the piezoelectric plate 3223*c*, the conducting electrode 3225*b*, the conductive frame 3225 and the conducting pin 3225*a* for transmitting the driving signal. Moreover, the insulation frame 3224 is insulated between the conductive frame 3225 and the actuator element 3223, so as to avoid the occurrence of a short circuit. Thereby, the driving signal is transmitted to the piezoelectric plate 3223*c*. After receiving the driving signal such as the driving frequency and the driving voltage, the piezoelectric plate 3223*c* deforms due to the piezoelectric effect, and the piezoelectric carrying plate 3223*a* and the adjusting resonance plate 3223*b* are further driven to generate the bending deformation in the reciprocating manner.

Furthermore, in the embodiment, the adjusting resonance plate 3223*b* is located between the piezoelectric plate 3223*c* and the piezoelectric carrying plate 3223*a* and served as a cushion between the piezoelectric plate 3223*c* and the piezoelectric carrying plate 3223*a*. Thereby, the vibration frequency of the piezoelectric carrying plate 3223*a* is adjustable. Basically, the thickness of the adjusting resonance plate 3223*b* is greater than the thickness of the piezoelectric carrying plate 3223*a*, and the vibration frequency of the actuator element 3223 can be adjusted by adjusting the thickness of the adjusting resonance plate 3223*b*.

Please further refer to FIG. 7A, FIG. 7B, FIG. 8A, FIG. 8B and FIG. 9A. In the embodiment, the gas-injection plate 3221, the chamber frame 3222, the actuator element 3223, the insulation frame 3224 and the conductive frame 3225 are stacked and positioned in the gas-guiding-component loading region 3215 sequentially, so that the piezoelectric actuator 322 is supported and positioned in the gas-guiding-component loading region 3215. A plurality of clearances 3221*c* are defined between the suspension plate 3221*a* of the gas-injection plate 3221 and an inner edge of the gas-guiding-component loading region 3215 for gas flowing therethrough. In the embodiment, a flowing chamber 3227 is formed between the gas-injection plate 3221 and the bottom surface of the gas-guiding-component loading region 3215. The flowing chamber 3227 is in communication with the resonance chamber 3226 between the actuator element 3223, the chamber frame 3222 and the suspension plate 3221*a* through the hollow aperture 3221*b* of the gas-injection plate 3221. By controlling the vibration frequency of the gas in the resonance chamber 3226 to be close to the vibration frequency of the suspension plate 3221*a*, the Helmholtz resonance effect is generated between the resonance chamber 3226 and the suspension plate 3221*a*, so as to improve the efficiency of gas transportation. When the piezoelectric plate 3223*c* is moved away from the bottom surface of the gas-guiding-component loading region 3215, the suspension plate 3221*a* of the gas-injection plate 3221 is driven to move away from the bottom surface of the gas-guiding-component loading region 3215 by the piezoelectric plate 3223*c*. In that, the volume of the flowing chamber 3227 is expanded rapidly, the internal pressure of the flowing chamber 3227 is decreased to form a negative pressure, and the gas outside the piezoelectric actuator 322 is inhaled through the clearances 3221*c* and enters the resonance chamber 3226 through the hollow aperture 3221*b*. Consequently, the pressure in the resonance chamber 3226 is increased to generate a pressure gradient. When the suspension plate 3221*a* of the gas-injection plate 3221 is driven by the piezoelectric plate 3223*c* to move toward the bottom surface of the gas-guiding-component loading region 3215, the gas in the resonance chamber 3226 is discharged out rapidly through the hollow aperture 3221*b*, and the gas in the flowing chamber 3227 is compressed, thereby the converged gas is quickly and massively ejected out of the flowing chamber 3227 under the condition close to an ideal gas state of the Benulli's law, and transported to the ventilation hole 3215*a* of the gas-guiding-component loading region 3215.

Figure 9A:
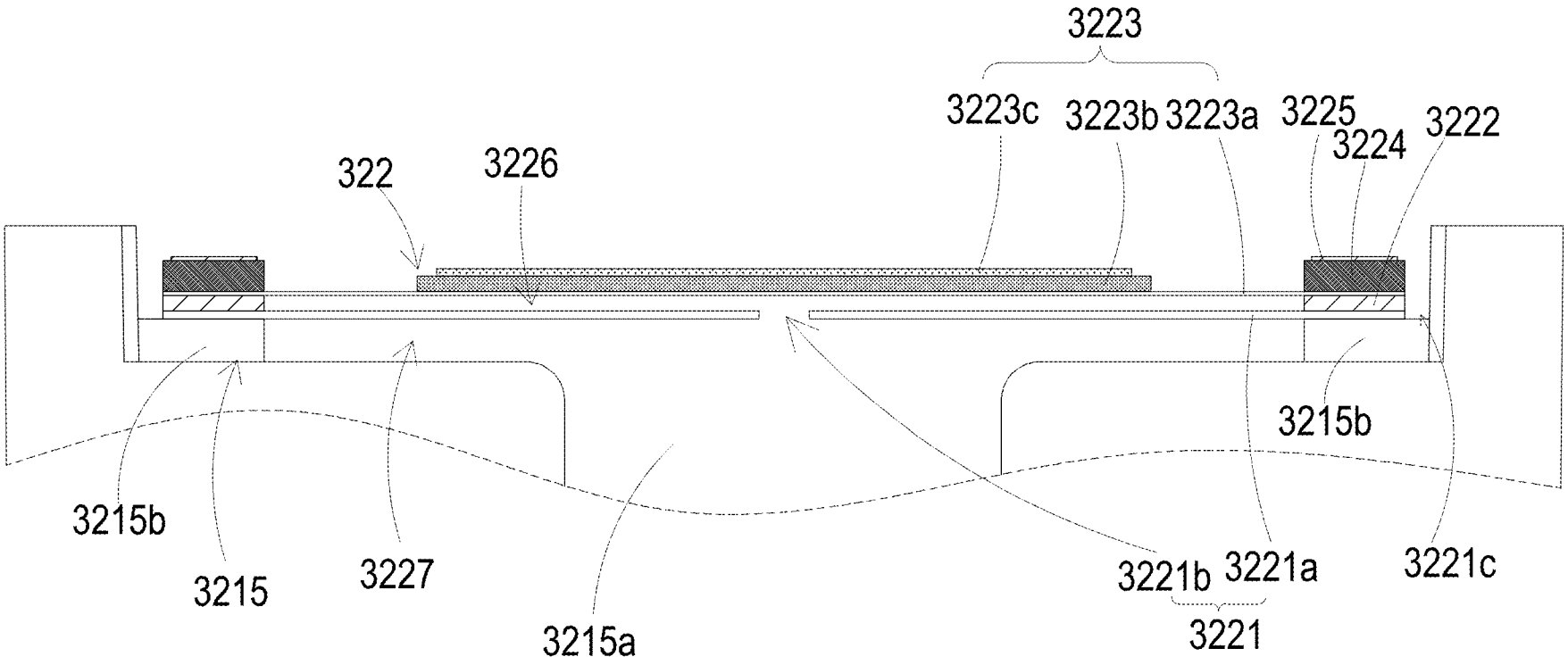
FIG. 9A is a schematic cross-sectional view (1) illustrating an action of the piezoelectric actuator according to the embodiment of the present disclosure.
Figure 9B:
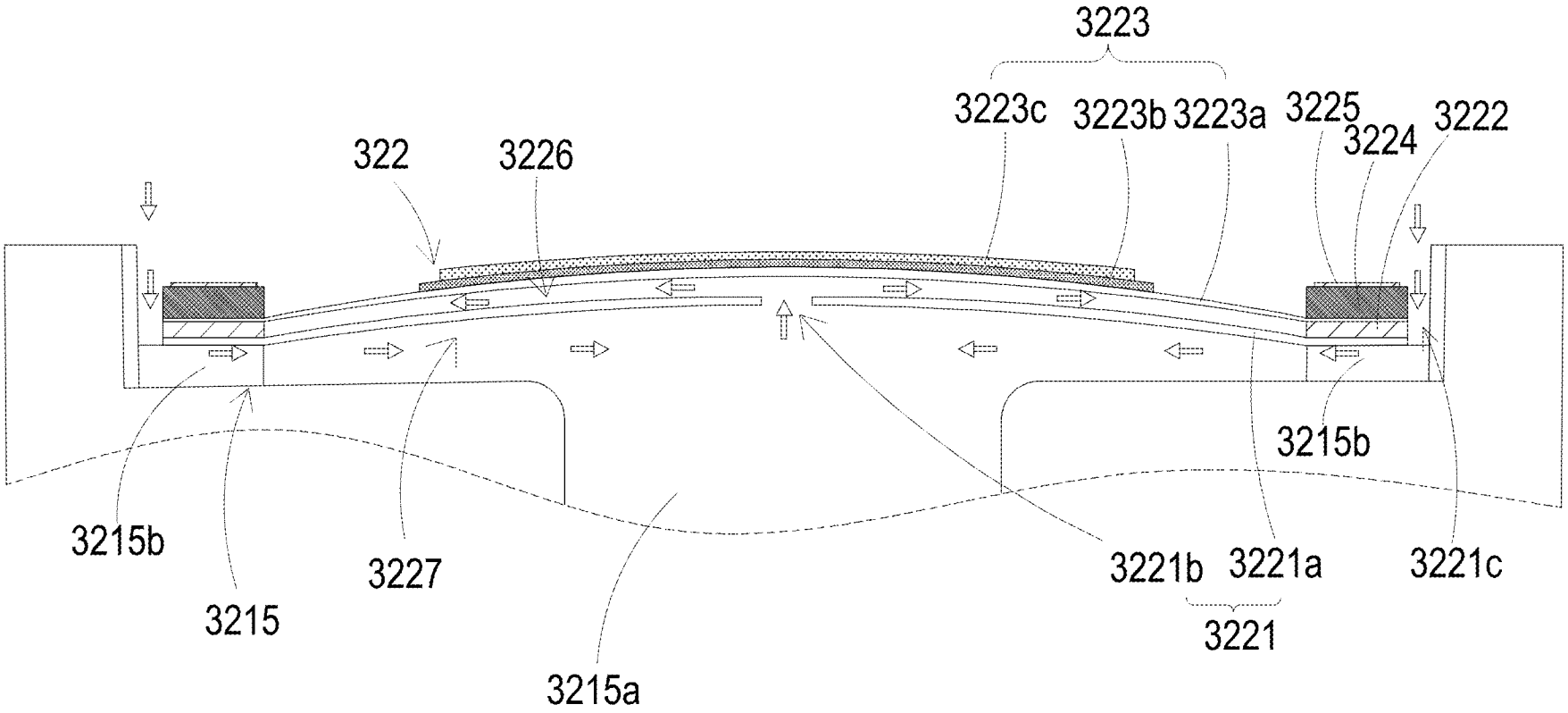
FIG. 9B is a schematic cross-sectional view (2) illustrating an action of the piezoelectric actuator according to the embodiment of the present disclosure.
Figure 9C:
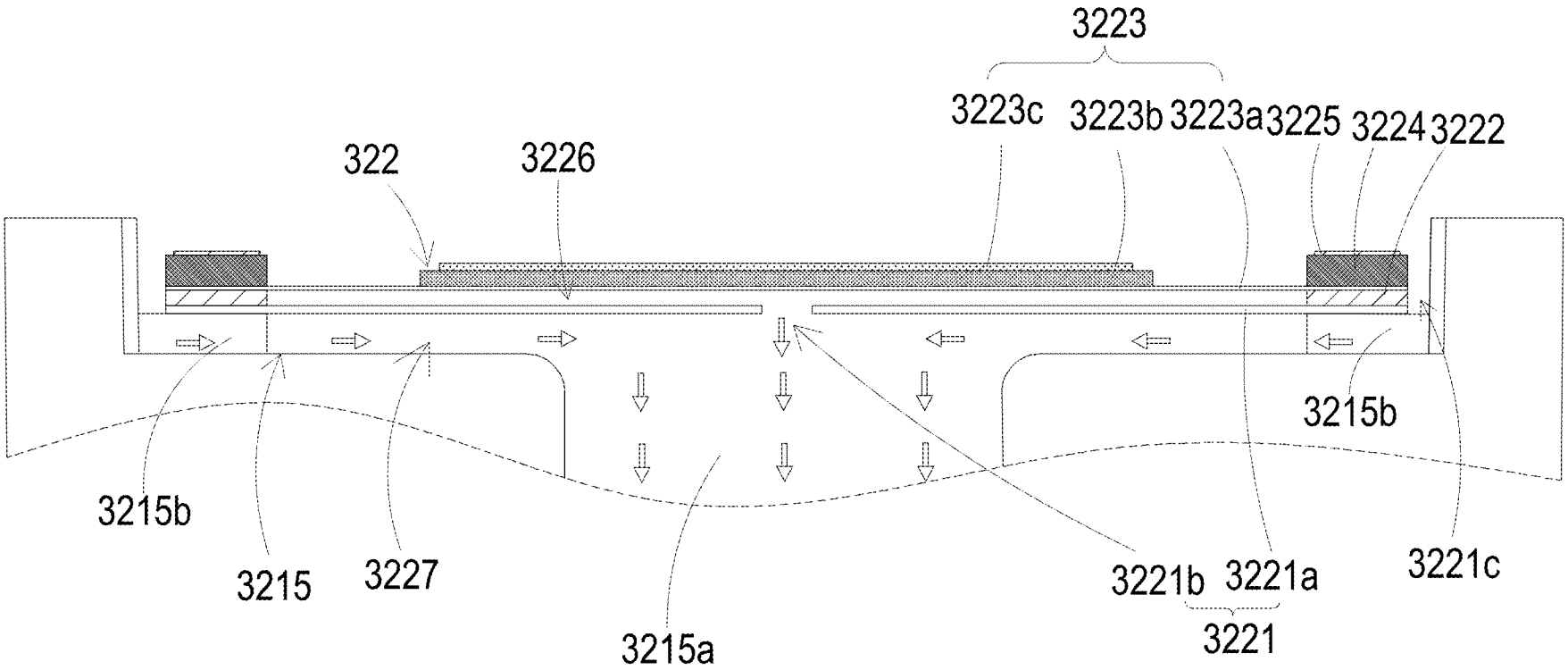
FIG. 9C is a schematic cross-sectional view (3) illustrating an action of the piezoelectric actuator according to the embodiment of the present disclosure.
Figure 10A:
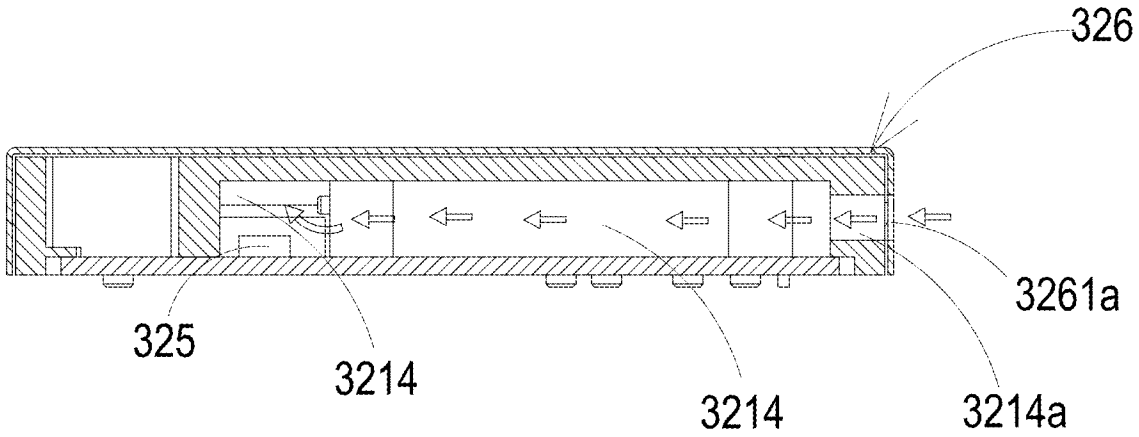
FIG. 10A is a schematic cross-sectional view (1) illustrating the gas detection main part according to the embodiment of the present disclosure.
Figure 10B:
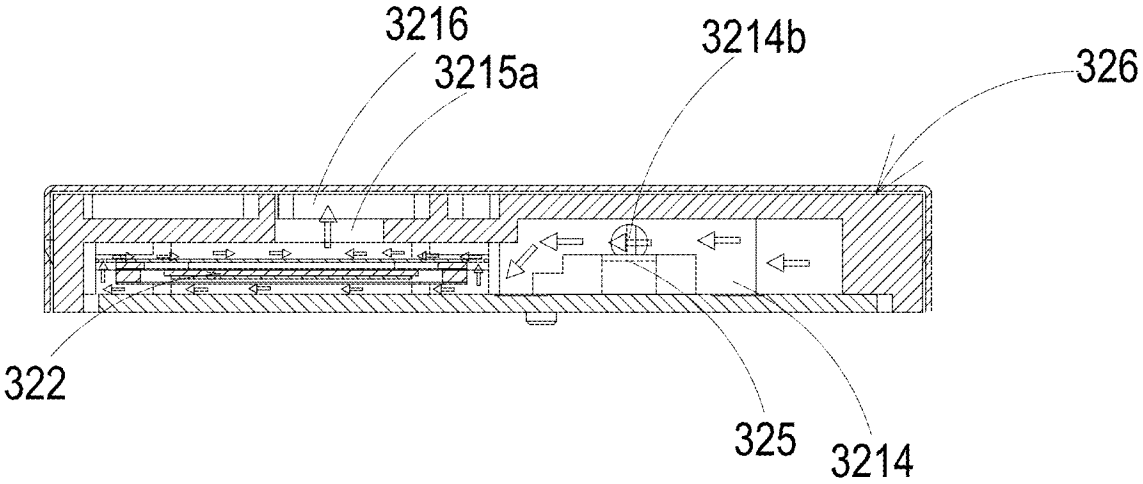
FIG. 10B is a schematic cross-sectional view (2) illustrating the gas detection main part according to the embodiment of the present disclosure.
Figure 10C:
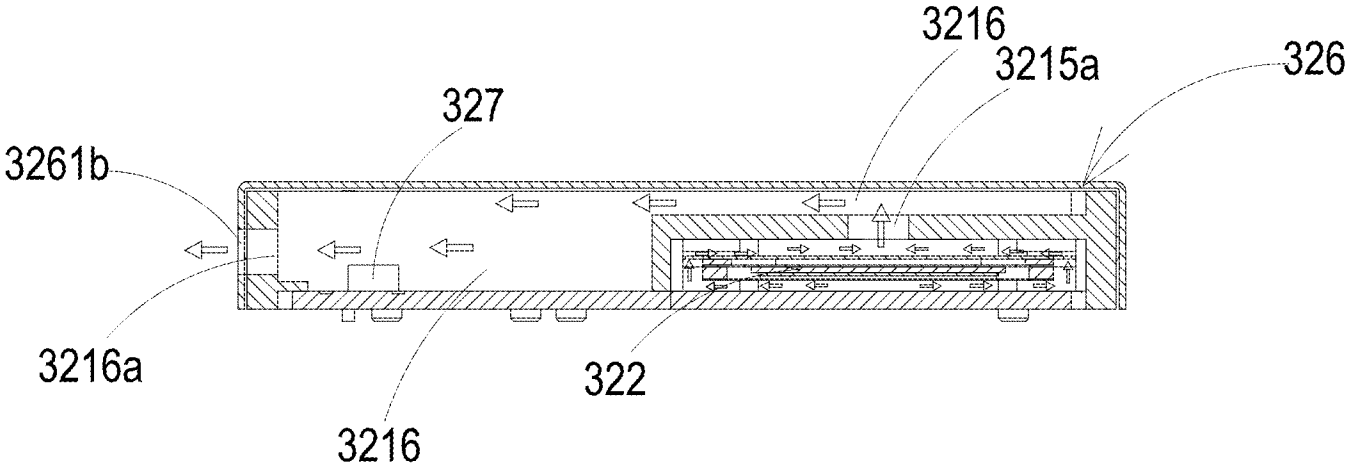
FIG. 10C is a schematic cross-sectional view (3) illustrating the gas detection main part according to the embodiment of the present disclosure.
Figure 11:
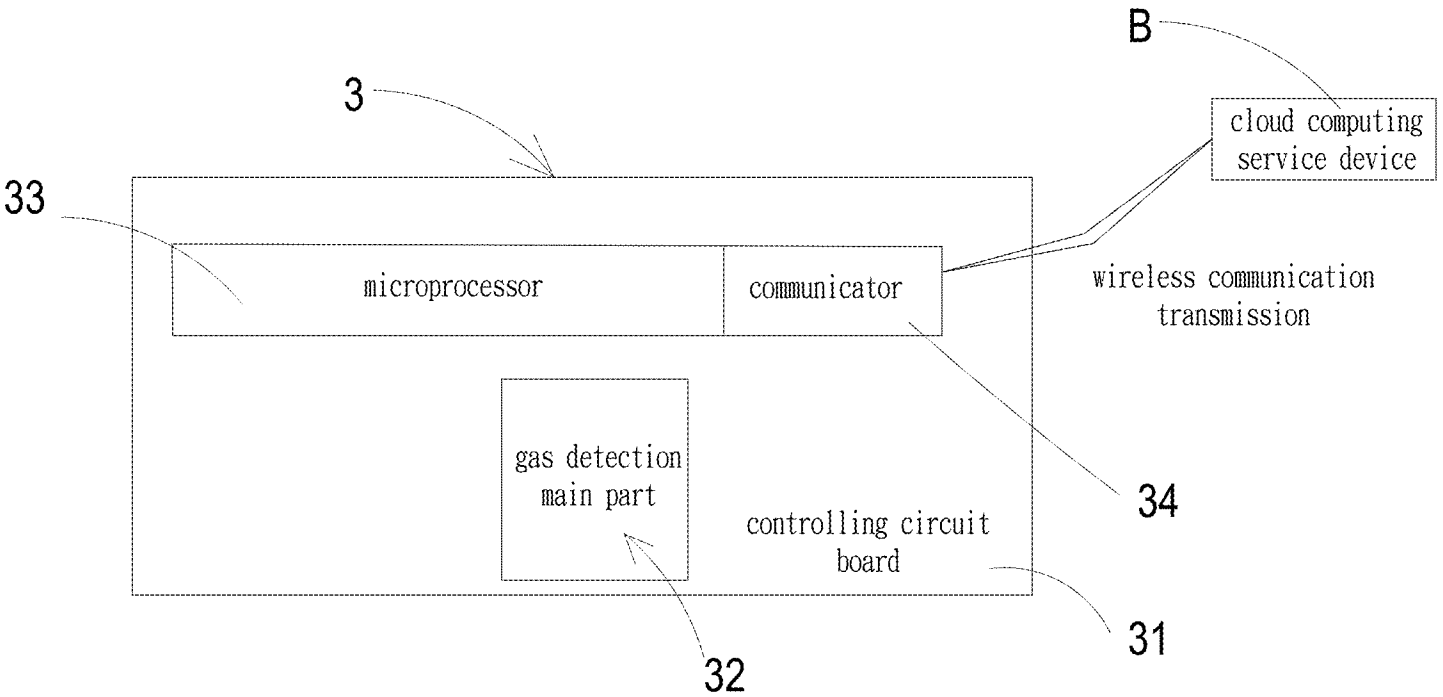
FIG. 11 is a schematic diagram illustrating the communication transmission of the gas detector according to the embodiment of the present invention.

By repeating the above operation steps shown in FIG. 9B and FIG. 9C, the piezoelectric plate 3223*c* is driven to generate the bending deformation in a reciprocating manner. According to the principle of inertia, since the gas pressure inside the resonance chamber 3226 is lower than the equilibrium gas pressure after the converged gas is ejected out, the gas is introduced into the resonance chamber 3226 again. Moreover, the vibration frequency of the gas in the resonance chamber 3226 is controlled to be close to the vibration frequency of the piezoelectric plate 3223*c*, so as to generate the Helmholtz resonance effect to achieve the gas transportation at high speed and in large quantities. The gas is inhaled through the gas-inlet 3214*a* on the outer cover 326, flows into the gas-inlet groove 3214 of the base 321 through the gas-inlet 3214*a*, and is transported to the position of the particulate sensor 325. The piezoelectric actuator 322 is enabled continuously to inhale the gas into the inlet path, and facilitate the gas outside the gas detection module to be introduced rapidly, flow stably, and transported above the particulate sensor 325. At this time, a projecting light beam emitted from the laser component 324 passes through the transparent window 3214*b* to irritate the suspended particles contained in the gas flowing above the particulate sensor 325 in the gas-inlet groove 3214. When the suspended particles contained in the gas are irradiated and generate scattered light spots, the scattered light spots are received and calculated by the particulate sensor 325 for obtaining related information about the sizes and the concentration of the suspended particles contained in the gas. Moreover, the gas above the particulate sensor 325 is continuously driven and transported by the piezoelectric actuator 322, flows into the ventilation hole 3215*a* of the gas-guiding-component loading region 3215, and is transported to the gas-outlet groove 3216. At last, after the gas flows into the gas outlet groove 3216, the gas is continuously transported into the gas-outlet groove 3216 by the piezoelectric actuator 322, and thus the gas in the gas-outlet groove 3216 is pushed to discharge through the gas-outlet 3216*a* and the outlet opening 3261*b*.

The gas detector 3 of the present disclosure not only includes particulate sensor 325 for detecting the particulate matters in the gas, but also includes a gas sensor for detecting the gas characteristics of the introduced gas, for example, to determine whether the gas is formaldehyde, ammonia, carbon monoxide, carbon dioxide, oxygen, ozone, or the like. Therefore, in one or some embodiments, the gas detector 3 of the present disclosure further includes the gas sensor 327 positioned and disposed on the driving circuit board 323, electrically connected to the driving circuit board 323, and accommodated in the gas-outlet groove 3216, so as to detect the concentration or the characteristics of volatile organic compounds contained in the gas exported from the gas outlet path.

In summary, the present disclosure provides an indoor air pollution prevention system. In order to solve the problem that indoor air pollution occurs at any time and is difficult to control, the indoor air pollution prevention system of the present disclosure includes a plurality of gas detectors arranged in various indoor field and outdoor field. With the arrangement, the gas detector determines a characteristic, a concentration and a location of an air pollution, and outputs to form air pollution data. Furthermore, the gas exchange device includes an intake channel communicated to an intake filter device and an exhaust channel communicated to an exhaust filter device. The cloud computing service device receives the air pollution data detected in the indoor field unit and the outdoor field unit, stores the air pollution data in an air pollution database, implements an artificial intelligence calculation to determine the location of the air pollution, and issues a control command to the intake filter device and the exhaust filter device to control activation operations of the intake filter device and the exhaust filter device. In that, the indoor gas and the outdoor gas are intelligently selected for exchange, and a directional airflow is generated in the indoor field unit to quickly guide the air pollution to the filter element for filtering and removal completely. Thereby, the indoor air pollution treatment of positioning the air pollution-guiding the air pollution-purifying the air pollution completely is formed for the detection, purification and prevention effects. The present disclosure includes the industrial applicability and the inventive steps.

What is claimed is:

1. An indoor air pollution prevention system comprising:

at least one indoor field unit, wherein the at least one indoor field unit is a space surrounded and isolated by a plurality of partitions;

a gas exchange device exchanging indoor gas and outdoor gas, and comprising at least one intake channel and at least one exhaust channel, wherein the at least one intake channel and the at least one exhaust channel are communicated to the at least one indoor field unit, the at least one intake channel is constructed in the at least one indoor field unit for inhaling the outdoor gas, and the at least one exhaust channel is constructed in the at least one indoor field unit for discharging the indoor gas;

an intake filter device embedded at one port position where the at least one intake channel is communicated and constructed in at least one of the plurality of partitions of the at least one indoor field unit, wherein the intake filter device comprises at least one intake fan, at least one intake filter element and an intake gate, wherein when the at least one intake fan is activated and the intake gate is opened at the same time, the outdoor gas in the at least one intake channel is guided by the at least one intake fan, to pass through the at least one intake filter element for filtration and removal and enter the at least one indoor field unit;

an exhaust filter device embedded at one port position where the at least one exhaust channel is communicated and constructed in at least one of the plurality of partitions of the at least one indoor field unit, wherein the exhaust filter device comprises at least one exhaust fan, at least one exhaust filter element and a exhaust gate, wherein when the at least one exhaust fan is activated and the exhaust gate is opened at the same time, the indoor gas in the at least one indoor field unit is guided by the at least one exhaust fan, to enter the at least one exhaust channel, pass through the at least one exhaust filter element for filtration and removal and be discharged out;

a plurality of gas detectors disposed in the at least one indoor field unit for detecting a characteristic, a concentration and a location of an air pollution, and outputting to form air pollution data; and a cloud computing service device, receiving the air pollution data detected in the at least one indoor field unit, storing the air pollution data in an air pollution database, implementing an artificial intelligence calculation to determine the location of the air pollution, and issuing a control command to the at least one indoor field unit with the air pollution generated, wherein an activation operation of the at least one exhaust fan of the exhaust filter device in the at least one indoor field unit is controlled, and the exhaust gate is opened at the same time, whereby a directional airflow is generated, and the air pollution in the at least one indoor field unit is guided quickly to the at least one exhaust filter element of the exhaust filter device for filtering and removal, so that the air pollution in the at least one indoor field unit is cleaned to reach a gas state of complete purification.

2. The indoor air pollution prevention system according to claim 1, wherein the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

3. The indoor air pollution prevention system according to claim 1, wherein the cloud computing service device comprises a wireless network cloud computing service module, a cloud control service unit, a device management unit and an application program unit.

4. The indoor air pollution prevention system according to claim 1, further comprising an outdoor field unit with at least one of the gas detectors disposed therein for outputting the air pollution data, wherein the cloud computing service device receives and compares the air pollution data detected in the at least one indoor field unit and the air pollution data detected in the outdoor field unit, wherein when the air pollution data detected in the at least one indoor field unit is higher than the air pollution data detected in the outdoor field unit, the cloud computing service device issues the control command to control the activation operations of the at least one intake fan of the intake filter device and the at least one exhaust fan of the exhaust filter device, and the intake gate and the exhaust gate are opened while the at least one intake fan and the at least one exhaust fan are activated, whereby the outdoor gas is introduced into the at least one indoor field unit through the at least one intake channel, and the air pollution in the at least one indoor field unit is guided and discharged out through the at least one exhaust channel, so that gas exchange of the at least one indoor field unit is formed to reach the gas state of complete purification.

5. The indoor air pollution prevention system according to claim 1, wherein the at least one indoor field unit is one selected from the group consisting of a living room, a bedroom, a family room, an office, a conference room, a tea room, a changing room, a gymnasium, a concert hall, a theater, an exhibition space, a hospital space, an airport space, a station space and a combination thereof, the at least one indoor field unit includes the exhaust filter device and at least one additional exhaust filter device, and the cloud computing service device receives and compares at least two or more of the air pollution data detected by the plurality of gas detectors in the at least one indoor field unit, intelligently calculates to position the location of the air pollution in the at least one indoor field unit, and intelligently selects to issue the control command to the exhaust filter device and the at least one additional exhaust filter device in the at least one indoor field unit, wherein one of the exhaust fans of the exhaust filter device and at least one additional exhaust filter device closest to the location of the air pollution is enabled for the activation operation firstly, then other exhaust fans of the exhaust filter device and at least one additional exhaust filter device are enabled for the activation operation, and the intake gate and the exhaust gate are opened at the same time, whereby the air pollution in the at least one indoor field unit is guided quickly to the filter elements of the exhaust filter device and at least one additional exhaust filter device for filtering and removal, and the air pollution in the at least one indoor field unit is cleaned to reach the gas state of complete purification.

6. The indoor air pollution prevention system according to claim 1, wherein the at least one indoor field unit is a kitchen field unit, the at least one indoor field unit includes a range hood, the range hood is connected with the at least one exhaust channel, and the cloud computing service device receives and compares the air pollution data detected by the plurality of gas detectors of the at least one indoor field unit, wherein when the air pollution data exceeds a safety detection value, the control command is intelligently selected and issued to the range hood in the at least one indoor field unit for the activation operation, and the air pollution is quickly guided and discharged out, so that the air pollution in the at least one indoor field unit is cleaned to reach the gas state of complete purification.

7. The indoor air pollution prevention system according to claim 6, wherein the plurality of gas detectors are constructed on the range hood.

8. The indoor air pollution prevention system according to claim 6, wherein the air pollution data include detection values of oil smoke, VOC and polycyclic aromatic hydrocarbons, wherein when the air pollution data detected exceeds a safety detection value, the control command is issued to the range hood in the at least one indoor field unit for the actuation operation.

9. The indoor air pollution prevention system according to claim 1, wherein the at least one indoor field unit is a bathroom field unit, the at least one indoor field unit includes an exhaust fan, the exhaust fan is connected with the at least one exhaust channel, and the cloud computing service device receives and compares the air pollution data detected by the plurality of gas detectors in the at least one indoor field unit, wherein when the air pollution data exceeds a safety detection value, the control command is intelligently selected and issued to the exhaust fan for the activation operation, and the air pollution is quickly guided and discharged out, so that the air pollution in the at least one indoor field unit is cleaned to reach the gas state of complete purification, and the temperature and the humidity of the at least one indoor field unit are controlled.

10. The indoor air pollution prevention system according to claim 9, wherein the plurality of gas detectors are constructed on the exhaust fan.

11. The indoor air pollution prevention system according to claim 9, wherein the air pollution data include detection values of $CO_2$, VOC, PM2.5, the temperature and the humidity, wherein when the air pollution data detected exceeds a safety detection value, the control command is issued to the exhaust fan in the at least one indoor field unit for the actuation operation.

12. The indoor air pollution prevention system according to claim 1, wherein each of the plurality of gas detectors comprises a controlling circuit board, a gas detection main part, a microprocessor and a communicator, and the gas detection main part, the microprocessor and the communicator are integrally packaged on the controlling circuit board and electrically connected to the controlling circuit board, wherein the microprocessor controls the detection of the gas detection main part, the gas detection main part detects the air pollution and outputs the gas detection data, and the microprocessor processes and provides the gas detection data to the communicator for an external communication transmission.

13. The indoor air pollution prevention system according to claim 12, wherein the gas detection main part comprises:

a base comprising:

a first surface;

a second surface opposite to the first surface;

a laser loading region hollowed out from the first surface to the second surface;

a gas-inlet groove concavely formed from the second surface and disposed adjacent to the laser loading region, wherein the gas-inlet groove comprises a gas-inlet and two lateral walls, the gas-inlet is in communication with an environment outside the base, and a transparent window is opened on the two lateral walls and is in communication with the laser loading region;

a gas-guiding-component loading region concavely formed from the second surface and in communication with the gas-inlet groove, wherein a ventilation hole penetrates a bottom surface of the gas-guiding-component loading region; and a gas-outlet groove concavely formed from the first surface, spatially corresponding to the bottom surface of the gas-guiding-component loading region, and hollowed out from the first surface to the second surface in a region where the first surface is not aligned with the gas-guiding-component loading region, wherein the gas-outlet groove is in communication with the ventilation hole, and a gas-outlet is disposed in the gas-outlet groove;

a piezoelectric actuator accommodated in the gas-guiding-component loading region;

a driving circuit board covering and attached to the second surface of the base;

a laser component positioned and disposed on the driving circuit board, electrically connected to the driving circuit board, and accommodated in the laser loading region, wherein a light beam path emitted from the laser component passes through the transparent window and extends in a direction perpendicular to the gas-inlet groove, thereby forming an orthogonal direction with the gas-inlet groove;

a particulate sensor positioned and disposed on the driving circuit board, electrically connected to the driving circuit board, and disposed at an orthogonal position where the gas-inlet groove intersects the light beam path of the laser component in the orthogonal direction, so that suspended particles contained in the air pollution passing through the gas-inlet groove and irradiated by a projecting light beam emitted from the laser component are detected;

a gas sensor positioned and disposed on the driving circuit board, electrically connected to the driving circuit board, and accommodated in the gas-outlet groove, so as to detect the air pollution introduced into the gas-outlet groove; and an outer cover covering the base and comprising a side plate, wherein the side plate has an inlet opening and an outlet opening, the inlet opening is spatially corresponding to the gas-inlet of the base, and the outlet opening is spatially corresponding to the gas-outlet of the base;

wherein the outer cover covers the base, and the driving circuit board covers the second surface, thereby an inlet path is defined by the gas-inlet groove, and an outlet path is defined by the gas-outlet groove, so that the air pollution is inhaled from the environment outside the base by the piezoelectric actuator, transported into the inlet path defined by the gas-inlet groove through the inlet opening, and passes through the particulate sensor to detect the particle concentration of the suspended particles contained in the air pollution, and the air pollution transported through the piezoelectric actuator is transported out of the outlet path defined by the gas-outlet groove through the ventilation hole, passes through the gas sensor for detecting, and then discharged through the outlet opening.

14. The indoor air pollution prevention system according to claim 13, wherein the particulate sensor is used for detecting suspended particulate information, and the gas sensor comprises a volatile-organic-compound sensor for detecting gas information of carbon dioxide ($CO_2$) or total volatile organic compounds (TVOC).

15. The indoor air pollution prevention system according to claim 13, wherein the gas sensor comprises a formaldehyde sensor, a bacteria sensor, a virus sensor or a combination thereof, the formaldehyde sensor is used for detecting gas information of formaldehyde (HCHO), the bacteria sensor is used for detecting gas information of bacteria or fungi, and the virus sensor used for detecting gas information of virus.

16. The indoor air pollution prevention system according to claim 1, wherein each of the intake filter element and the exhaust filter element is a high efficiency particulate air (HEPA) filter screen to clean the air pollution through a physical way of blocking and absorbing, and the high efficiency particulate air (HEPA) filter screen is combined with a decomposition layer to clean the air pollution through a chemical way.

17. The indoor air pollution prevention system according to claim 16, wherein the decomposition layer comprises at least one selected from the group consisting of an activated carbon, a cleansing factor containing chlorine dioxide layer, an herbal protective layer extracted from ginkgo and Japanese *Rhus chinensis*, a silver ion, a zeolite and a combination thereof.

18. The indoor air pollution prevention system according to claim 1, wherein each of the intake filter element and the exhaust filter element is combined with one selected form the group consisting of a light irradiation element, a decomposition unit and a combination thereof to sterilize the air pollution in chemical means.

19. The indoor air pollution prevention system according to claim 18, wherein the light irradiation element is at least one selected from the group consisting of a photo-catalyst unit comprising a photo catalyst and an ultraviolet lamp, a photo-plasma unit comprising a nanometer irradiation tube and a combination thereof.

20. The indoor air pollution prevention system according to claim 18, wherein the decomposition unit is at least one selected from the group consisting of a negative ion unit, a plasma ion unit and a combination thereof.

* * * * *